US007931414B2

(12) United States Patent
Takahashi

(10) Patent No.: US 7,931,414 B2
(45) Date of Patent: Apr. 26, 2011

(54) PRINTING APPARATUS AND PRINTING METHOD

(75) Inventor: Seiji Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 509 days.

(21) Appl. No.: 11/280,245

(22) Filed: Nov. 17, 2005

(65) Prior Publication Data

US 2006/0127156 A1 Jun. 15, 2006

(30) Foreign Application Priority Data

Dec. 10, 2004 (JP) ..... 2004-358834

(51) Int. Cl.
*B41J 19/00* (2006.01)
*B41J 11/00* (2006.01)
*B41J 15/00* (2006.01)

(52) U.S. Cl. ..... 400/283; 400/303; 347/37; 347/39

(58) Field of Classification Search ..... 400/283, 400/303, 319; 347/37, 39
See application file for complete search history.

(56) References Cited

U.S. PATENT DOCUMENTS 6,390,698 B1 * 5/2002 Yoshida et al. ..... 400/356
7,284,813 B2 * 10/2007 Otsuki ..... 347/19

FOREIGN PATENT DOCUMENTS

| | | |
|---|---|---|
| JP | 04-141480 | 5/1992 |
| JP | 2000-071539 | 3/2000 |
| JP | 2000-166296 A | 6/2000 |
| JP | 2002-41958 A | 2/2002 |
| JP | 2004-106196 A | 4/2004 |
| JP | 2004-130620 A | 4/2004 |

OTHER PUBLICATIONS

Japanese Office issued May 14, 2010, in Japanese patent application No. 2004-358834.

* cited by examiner

*Primary Examiner* — Ren Yan
*Assistant Examiner* — Marissa L Ferguson-Samreth
(74) *Attorney, Agent, or Firm* — Fitzpatrick, Cella, Harper & Scinto

(57) ABSTRACT

A printing apparatus and method can control vibration generated resulting from the movement of a carriage to be small even when a desired printing pattern, etc., may change. The carriage is moved based on a plurality of drive conditions, each specifying a different moving distance of the carriage, and a drive condition by which vibration generated at that time becomes not larger than a predetermined magnitude is set as a drive condition of the carriage when printing an image on a printing medium.

6 Claims, 16 Drawing Sheets

| no. | CONSTANT-SPEED DISTANCE (Ln) | ACCELERATION TIME (A) | CONSTANT-SPEED TIME (Bn) | DECELERATION TIME (C) | MOVING DISTANCE (Dn) | (1 ROUND-TRIPTIME) |
|---|---|---|---|---|---|---|
| 0 | $L0=\ell$ | A | $B0(=\ell/VT)$ | C | D0 | $T0=(A+B0+C)\times 2$ |
| 1 | $L1=L0+\ell$ | A | $B1=B0+\ell/VT$ | C | $D1=D0+\ell$ | $T1=(A+B1+C)\times 2$ |
| ⋮ | ⋮ | ⋮ | ⋮ | ⋮ | ⋮ | ⋮ |
| n | $Ln=Ln-1+\ell$ | A | $Bn=Bn-1+\ell/VT$ | C | $Dn=Dn-1+\ell$ | $Tn=(A+Bn+C)\times 2$ |

FIG.8

| no. | CONSTANT-SPEED DISTANCE | ACCELERATION TIME | CONSTANT-SPEED TIME | DECELERATION TIME | MOVING DISTANCE | (1 ROUND-TRIP TIME) |
|---|---|---|---|---|---|---|
| 0 | $L0=\ell 2$ | A2 | $B0\ (=\ell/VT2)$ | C2 | D0 | $T0=(A2+B0+C2)\times 2$ |
| 1 | $L1=L0+\ell 2$ | A2 | $B1=B0+\ell/VT2$ | C2 | $D1=D0+\ell 2$ | $T1=(A2+B1+C2)\times 2$ |
| ⋮ | ⋮ | ⋮ | ⋮ | ⋮ | ⋮ | ⋮ |
| n | $Ln=Ln\text{-}1+\ell 2$ | A2 | $Bn=Bn\text{-}1+\ell/VT2$ | C2 | $Dn=Dn\text{-}1+\ell 2$ | $Tn=(A2+Bn+C2)\times 2$ |

FIG.15

PRINTING APPARATUS AND PRINTING METHOD

BACKGROUND OF THE INVENTION

1. Field of the Invention

This invention relates to a printing apparatus, such as a printer and a copier, and to a printing method, and more specifically to a printing apparatus and a printing method that can control vibration generated resulting from movement of a carriage capable of carrying a printing head to be small. Especially, the invention relates to a printing apparatus and a printing method that, when the printing apparatus is installed on an installation base, such as a table and a rack, can control vibration of the installation base and other devices installed on the installation base to be small.

2. Description of the Related Art

Conventionally copiers and printers are well known as the printing apparatus. As for the printer, for example, there is one that has a movable carriage carrying a printing head and uses a serial scanning method. Carriages in the printers of this method each make a reciprocating movement in a direction (main scanning direction) that intersects a conveyance direction (in a sub scanning direction) of a printing medium, such as paper and film (hereinafter referred to also as "printing sheet," "paper," and "paper form"). The printing head does printing scanning while moving with the carriage. By repeating such printing scanning and a conveyance operation of a printing medium, an image is printed on the printing medium. The printer of such a serial scanning method has spread widely for reasons that the structure can be simplified and the like.

The carriage is made to make a reciprocating movement accompanying a printing operation by using, for example, a driving source of a DC motor etc. and driving force transferring means of an endless timing belt etc. Generally, the carriage goes to an acceleration state in which the moving speed increases gradually after starting of the movement in one direction, and changes to a constant speed state. In this constant speed state, the printing head prints an image on the printing medium. After completion of such printing scanning in the one direction, the carriage is controlled to go to a deceleration state in which the moving speed decreases gradually and stop at a predetermined position. Subsequently, after conveying a predetermined amount of paper form, the carriage is made to start the movement in the other direction and controlled in driving as in the printing scanning in the one direction, whereby the printing head performs printing scanning in the other direction.

Generally, the printing apparatus including such a printer is used being put on the installation base, such as a table, rack, or the like. At that same time, on this installation base, there is often the case where a personal computer (also called a PC) for transmitting desired print information and creating and processing the desired printing information and a monitor device for displaying various pieces of information that this personal computer handles are installed. Moreover, in the so-called rack etc., generally, the whole system is configured in such a way that a printing apparatus is installed at a position higher than the personal computer, the monitor device, etc.

When installing the printing apparatus in such a table, rack, or the like and making it operate, the table, rack, or the like is likely to vibrate caused by reactive force generated by a driving source, such as a motor, for driving the carriage inside the printing apparatus and translation of a center-of-gravity position of the printing apparatus resulting from movement of the carriage itself. Moreover, there is a possibility that installed objects, such as a personal computer, on this table, rack, or the like are caused to vibrate. For example, when installing the printing apparatus on a table, rack, or the like, and making it operate, there is a possibility that a natural vibration period of a whole system including the installation base, such as a table and a rack, and installed devices, such as the printing apparatus and the personal computer, becomes resonant with a period of the reciprocating movement of the carriage.

FIG. 11 is a diagram illustrating a case where a table, rack, or the like fall in a resonant state. FIG. 11 shows temporal variation of the acceleration in a carriage scanning direction during the printing operation and temporal variation of the acceleration of the neighborhood of the printing apparatus in a rack on which the printing apparatus is installed in the carriage scanning direction. FIG. 11 clearly shows that the movement of the carriage causes a vibration of the rack close to a sinusoidal wave, resulting in an almost resonant state of the carriage and the rack. When the carriage and the rack become in such a condition, the table or the rack or the like will vibrate greatly.

As a method of preventing such large vibration, a vibration prevention base equipped with a function of attenuating the vibration of a printing apparatus, such as a printer, that is a generation source of vibration is known. Such vibration prevention bases have various configurations. For example, there are one that is equipped with a damper using elasticity or viscosity etc., one that controls vibration by absorbing horizontal vibration generated by a printer using a rack and pinion on an arc (e.g., see Japanese Patent Application Laid-open No. 4-141480 (1992)), and the like.

Moreover, a method is proposed where a vibration sensor for detecting vibration of a table, rack, or the like is provided in a printing apparatus, a plurality of parameters each consisting of a speed at which a carriage is moved and a stop time at the time of reversing a movement direction of the carriage are prepared in advance, and the carriage is driven based on one set of parameters (e.g., see Japanese Patent Application Laid-open No. 2000-071539). In this method, in advance of the printing operation, the carriage is made to make a reciprocating movement based on predetermined parameters from among the plurality of parameters and a swing detection sensor detects swing of the installation base at this time. Then, if the swing of the installation base exceeds a predetermined value, another parameter is selected from among the plurality of parameters and the carriage is made to make a reciprocating movement based on the newly selected parameter, and the swing of the installation base is detected. The parameter with which the swing of the installation base becomes equal to or smaller than (hereinafter described as "not larger than" for simplicity) the predetermined value is selected, and the parameter with which the swing of the installation base becomes not larger than the predetermined value is used fixedly to drive the carriage.

However, in the case where vibration of the installation base and the installed devices installed on the installation base that is generated resulting from operations of the printing apparatus is prevented by the conventional configuration and a method like this, the following new problems will arise. That is, in order to equip an installation base of a printing apparatus etc. with a vibration prevention function, it is necessary for a user to newly purchase an installation base equipped with the vibration prevention function in addition to a table, rack, or the like on which the printing apparatus is installed, which makes it difficult to use such printing apparatus cheaply.

Moreover, in a configuration as disclosed in Japanese Patent Application Laid-open No. 2000-071539, a plurality of carriage speeds and a plurality of stop times at the time of starting the reciprocal movement are used; a carriage speed and a stop time that minimize the vibration of the printing apparatus are selected and subsequently the speed and the stop time thus selected are used fixedly. Therefore, when desiring a printing result such that movements of the carriage differ widely, round-trip times of the carriage are made different in various ways, and consequently it is likely that an effect of preventing the vibration of the printing apparatus cannot be achieved sufficiently.

Furthermore, in order to fully achieve the vibration prevention effect in the printing apparatus, it is necessary to fix the selected speed of the carriage and the selected stop time at the time of reversing a movement direction. As a result, the movement of the carriage (scanning width) will be fixed, and accordingly the one round-trip time of the carriage will be fixed. Therefore, even when the movement of the carriage required for actual printing (scanning width) is small compared to the movement of the carriage determined for the selected speed, it is necessary to make the carriage move for the movement as determined previously for the selected speed. As a result, a time required for printing will become long.

SUMMARY OF THE INVENTION

The object of this invention is to provide a printing apparatus and a printing method for controlling vibration that is generated resulting from the movement of a carriage to be small even when a desired printing pattern etc. may change.

In the first aspect of the present invention, there is provided a printing apparatus for printing an image on a printing medium accompanying a reciprocating movement of a carriage capable of carrying a printing head, comprising:

movement control means for making the carriage movement based on a plurality of drive conditions that have different moving distances of the carriage; and setting means for setting a drive condition with which vibration generated when the movement control means makes the carriage movement is not larger than a predetermined magnitude to a drive condition of the carriage when an image is printed on the printing medium.

In the second aspect of the present invention, there is provided a method for printing an image on a printing medium accompanying a reciprocating movement of a carriage capable of carrying a printing head, comprising the steps of:

making the carriage movement based on a plurality of drive conditions by each of which the moving distance of the carriage is different from one another, and setting a drive condition by which vibration generated at that time becomes not larger than a predetermined magnitude to a drive condition of the carriage by which the image is printed on the printing medium.

In the third aspect of the present invention, there is provided a printing apparatus for printing an image on a printing medium accompanying a reciprocating movement of the carriage capable of carrying a printing head, comprising:

movement control means for making the carriage movement based on a plurality of drive conditions by each of which a moving distance of the carriage is different from one another; and setting means for setting a drive condition from which a drive condition resulting in vibration generated when the movement control means makes the carriage movement becomes more than a predetermined magnitude is excluded, to a drive condition of the carriage when printing the image on the printing medium.

In the fourth aspect of the present invention, there is provided a method for printing an image on a printing medium accompanying a reciprocating movement of a carriage capable of carrying a printing head, comprising the steps of:

moving the carriage based on a plurality of drive conditions by each of which the moving distance of the carriage is different from one another; and setting a drive condition from which a drive condition by which vibration generated at that time becomes more than a predetermined magnitude is excluded, to a drive condition of the carriage when printing the image on the printing medium.

According to this invention, for example when the printing apparatus is used being installed on an installation base, such as a table and a rack, the moving distance of the carriage is so set that the vibration generated resulting from the movement of the carriage in the printing apparatus is controlled small. By this setting, even when a desired printing pattern etc. changes, the vibration of the installation base can be controlled small.

Moreover, a plurality of moving distances of the carriage for controlling the vibration generated resulting from the movement of the carriage to be small are prepared and these distances are used selectively to perform the printing operation, whereby a decrease in throughput can be controlled to be as small as possible.

The above and other objects, effects, features and advantages of the present invention will become more apparent from the following description of embodiments thereof taken in conjunction with the accompanying drawings.

BRIEF DESCRIPTION OF THE DRAWINGS

FIG. 8 is a diagram for illustrating a set of drive conditions of the carriage of the ink-jet printing apparatus in the first embodiment of this invention;

FIG. 15 is a diagram for illustrating a set of drive conditions of the carriage when the vibration is measured in a second embodiment of this invention.

DETAILED DESCRIPTION OF PREFERRED EMBODIMENTS

Hereafter, embodiments of this invention will be described based on the drawings. In the following embodiments, a printer using the ink-jet printing method will be taken as an example for describing the invention. It is natural that this invention can be applied to various printing apparatuses other than those of the ink-jet printing method.

First Embodiment

First, a "device main body" and a "printing operation mechanism" of a printer according to this embodiment will be explained.

(Device Main Body)

Figure 1:
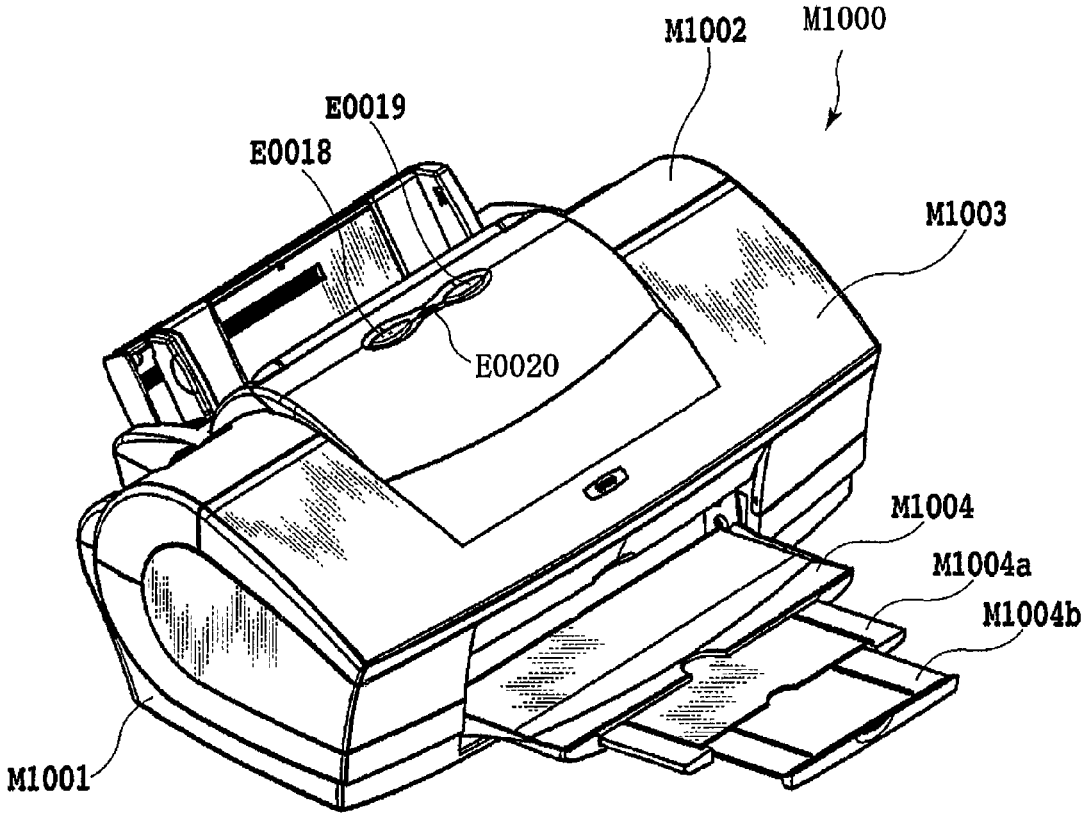
FIG. 1 is an appearance perspective diagram of an ink-jet printing apparatus in a first embodiment of this invention.
Figure 2:
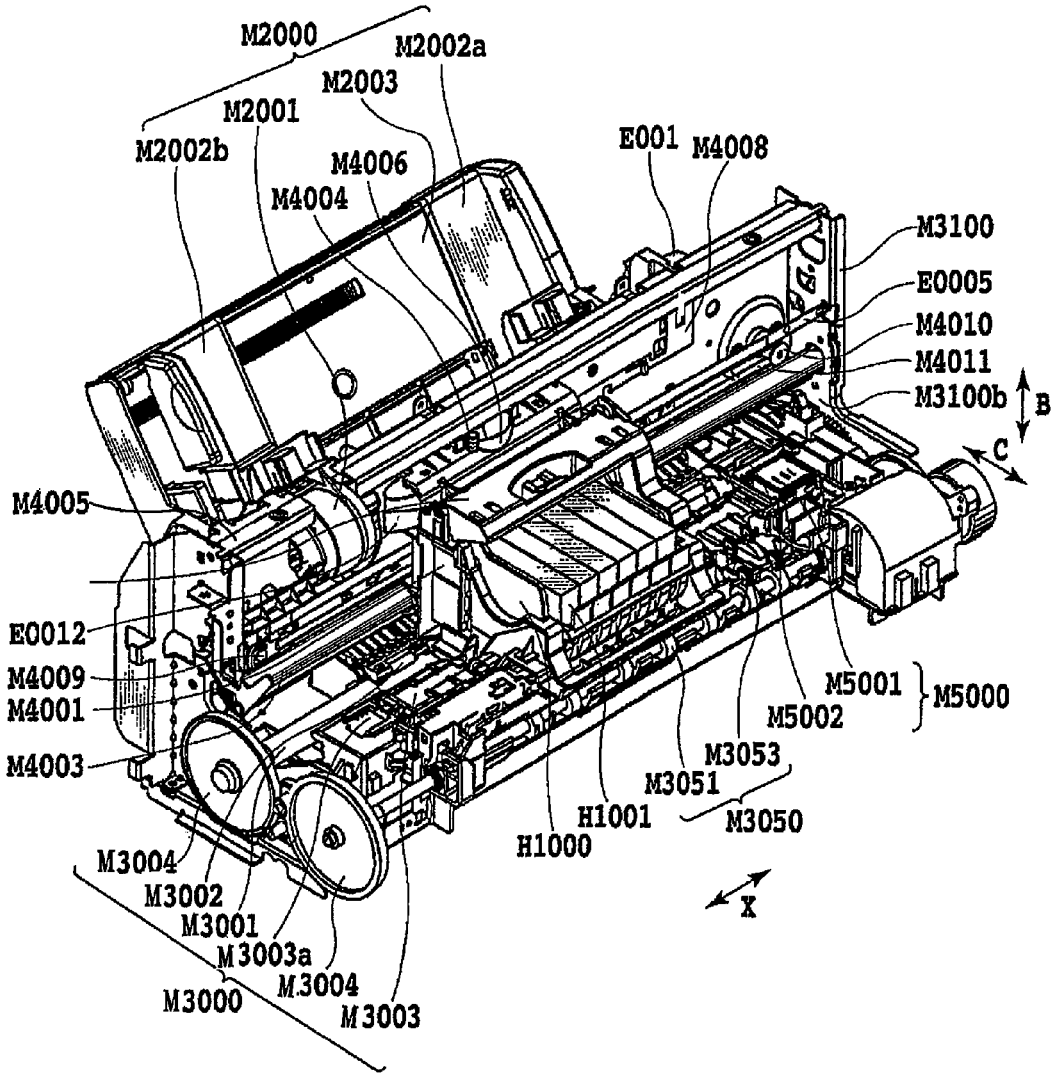
FIG. 2 is a perspective diagram of a part of a main internal structure in the ink-jet printing apparatus of FIG. 1.
Figure 3:
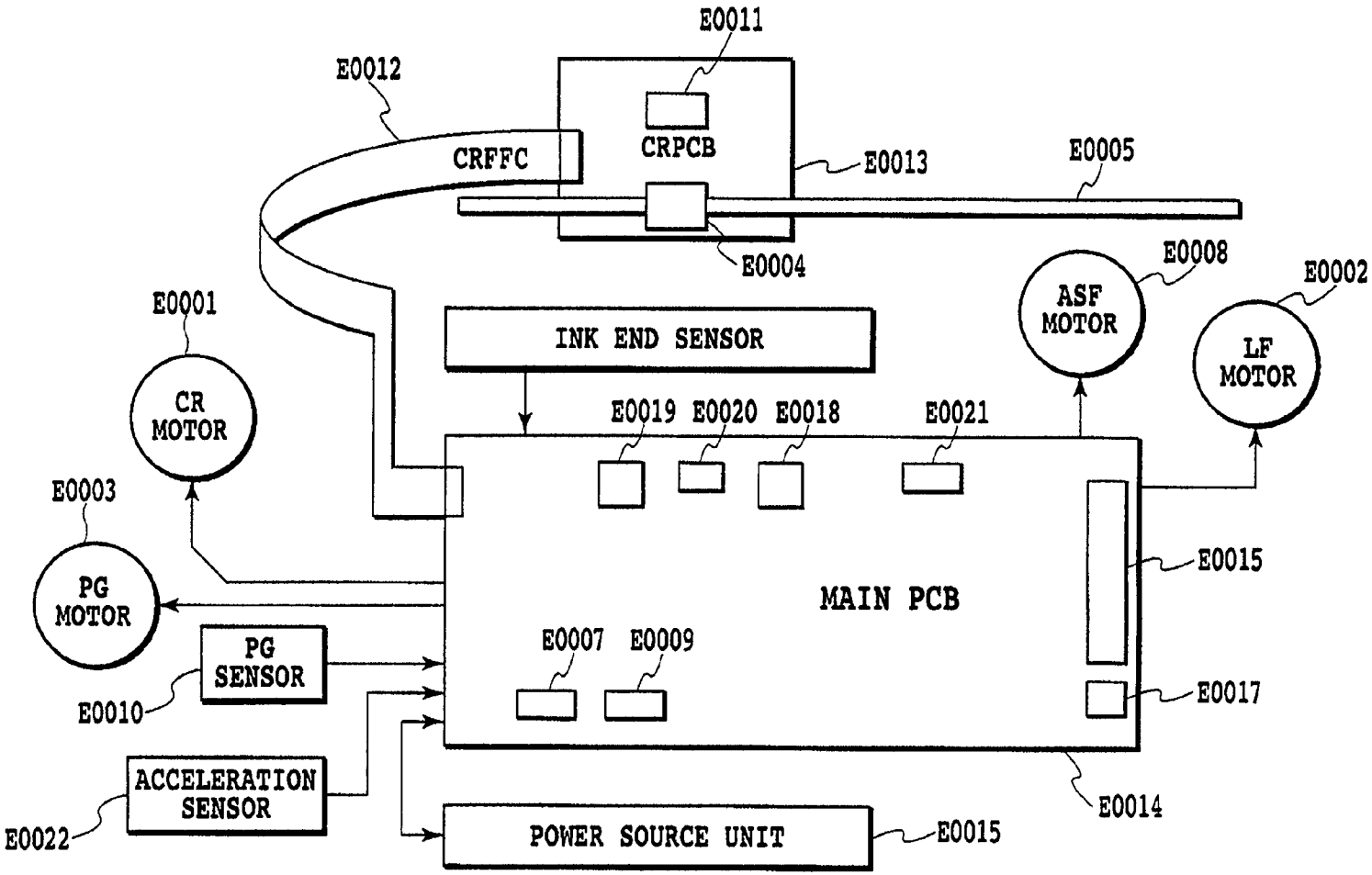
FIG. 3 is a block diagram for explaining electric circuitry in the ink-jet printing apparatus of FIG. 1.

FIGS. 1, 2, and 3 show an outline structure of a printer of this example that uses the ink-jet printing method.

In FIG. 1, the device main body M1000 that constitutes an outer shell of the printer is constructed with the lower case M1001, the upper case M1002, an access cover M1003, an exterior member of a paper output tray M1004, and a chassis M3100 accommodated in the exterior member (see FIG. 2). A chassis M3100 is constructed with a plurality of sheet-like metal members each having predetermined rigidity, making a frame of the printer, and holds printing operation mechanisms that will be described later. The paper output tray M1004 accommodates two sheets of auxiliary trays M1004*a*, M1004*b*, which are set to be able to be pulled out frontward if needed.

The access cover M1003 is held on the upper case M1002 rotatably at its end, and an opening formed on a top face of the upper case M1002 can thereby be opened and closed. By opening this access cover M1003, it becomes possible to change a printing head cartridge H1000, an ink tank H1001, etc. accommodated in the interior of the device main body. Moreover, on a rear top face of the upper case M1002, a power source key E0018 and a resume key E0019 are formed to be depressible and a LED E0020 is provided. When the power source key E0018 is pressed down, the LED E0020 is turned on, letting the operator know that the printing apparatus is ready to print. The LED E0020 has various display functions, such as telling the operator about the status of the printer by means of a way of blinking and change of a color.

(Printing Operation Mechanism)

Next, the printing operation mechanism that is accommodated in and retained by the printer device main body M1000 will be explained.

The printing operation mechanism in this embodiment is constructed with an automatic feeding unit M2000, a conveyance unit M3000, a printing unit, and a restoration unit M5000. The automatic feeding unit M2000 automatically feeds a printing sheet P into the device main body. The conveyance unit M3000 leads the printing sheet P that is sent out from the automatic feeding unit M2000 one by one to a printing position and also guides the printing sheet to a paper output unit M3050 from the printing position. The printing unit performs desired printing on the printing sheet P conveyed by the conveyance unit M3000. The restoration unit M5000 performs restoration processing on the printing unit, etc.

Next, structures of these mechanical units will be explained.

(Automatic Feeding Unit)

First, the automatic feeding unit M2000 will be explained based on FIG. 2.

The automatic feeding unit M2000 in this embodiment loads the printing sheet P so that it makes an angle of about 300 to 600 to the horizontal plane. Then, the automatic feeding unit M2000 sends out the printing sheet P horizontally and feeds it into the main body from an un-illustrated mouth while keeping it substantially horizontally.

The automatic feeding unit M2000 is equipped with a feeding roller M2001, a movable side guide M2002, a press plate M2003, an un-illustrated separation claw, a separation sheet, etc. The side guide M2002 is constructed with a pair of sheet guides M2002*a* and M2002*b*. One sheet guide M2002*b* is set in a horizontally movable manner, so that it is compatible to various horizontal widths of a variety of printing sheets. A top leaf of printing sheet among the printing sheet P loaded on the press plate M2003 is separated one by one both by rotation of the feeding roller M2001 driven by an un-illustrated ASF motor and by a separation action of the separation claw and the separation sheet, and sent out sequentially being separated. The separated printing sheet P is conveyed to the conveyance unit M3000.

(Conveyance Unit)

The conveyance unit M3000 is equipped with an LF roller M3001, a pinch roller M3002, a platen M3003, etc. The LF roller M3001 is attached to a drive shaft supported rotatably by the chassis M3100, etc., and driven to rotate by an LF motor E0002 through a LF gear sequence M3004. The pinch roller M3002 is attached to the pinch roller holder at its top end that is supported rotatably by the chassis M3100, so that the pinch roller M3002 is rotatable. This pinch roller M3002 is made to contact with the LF roller M3001 by being pressed by a pinch roller spring in the form of a coil spring that applies a force to the pinch roller holder. The pinch roller M3002 rotates by rotation of the LF roller M3001 and conveys the printing sheet P while supporting it on its both sides along with the LF roller M3001. The printing sheet P is conveyed while being supported by the platen M3003.

In the conveyance unit constructed in this way, after a conveyance operation by the feeding roller M2001 of the automatic feeding unit M2000 stopped and a constant time lapsed, the LF motor E0002 start to drive the LF roller M3001. Then, the printing sheet whose top end is abutted to a nip part between the LF roller M3001 and the pinch roller M3002 is conveyed to a printing start position on the platen M3003 by rotation of the LF roller M3001.

(Paper Output Unit)

Next, the paper output unit M3050 will be explained.

The paper output unit M3050 has a rotatable output roller M3051 to which a driving force of the LF motor E0002 is transferred through a predetermined gear sequence. A spur M3053 provided in a spur stay M3052 rotates being driven by the rotation of this output roller M3051. The printing sheet P is outputted by the output roller M3051 and the spur M3053.

When printing on the printing sheet P is completed and the rear end of the printing sheet P goes out from between the LF roller M3001 and the pinch roller M3002, the printing sheet is conveyed only by the output roller M3051 and the spur M3053. This conveyance completes outputting of the printing sheet P.

(Printing Unit)

Next, the printing unit M4000 will be explained.

The printing unit M4000 is equipped with, as main constituents, a carriage shaft M4003, a carriage M4001, and the printing head cartridge H1000. The carriage M4001 is movably supported by the carriage shaft M4003 and a carriage rail M4005. The printing head cartridge H1000 is detachably mounted on the carriage M4001. The printing head cartridge H1000 is exchange ably equipped with the ink tank H1001 for supplying ink to an un-illustrated printing head unit.

The printing head unit is structured to discharge the ink supplied from the ink tank H1001. For an ink discharging method, various methods using an electricity-to-heat converter (heater), a piezoelectric element, etc. can be adopted. In the case where the electricity-to-heat converter is used, heat generated when energizing the electricity-to-heat converter can make the ink form bubble in it. The ink can be discharged from the discharge orifice by using its bubble forming energy.

The carriage M4001 is provided with a head set lever as shown in FIG. 2. This head set level, by being engaged with the carriage M4001, guides the printing head cartridge H1000 to a predetermined attaching position in the carriage M4001 and presses it to be set. The head set lever is provided on an upper part of the carriage M4001, and is equipped with an un-illustrated spring at the engagement portion between itself and the printing head cartridge H1000. The head set lever makes the printing head cartridge H1000 mount on the carriage M4001 by pressing it using this spring force.

A paper gap change lever M4004 for changing a gap between the printing head cartridge H1000 mounted on the carriage M4001 and the platen M3003 is provided on the upper part of the carriage M4001. This paper gap change lever M4004 rotates about an un-illustrated shaft provided on the top of the carriage M4001 in a direction of the arrow X in FIG. 2 while being guided by a guide part M4006. A pair of un-illustrated latch parts for latching rotation of the paper gap change lever M4004 is provided on both ends of the guide part M4006. When the paper gap change lever M4004 is rotated to the left direction, the paper gap change lever M4004 is latched and positioned by one of the latch parts. On the other hand, when the paper gap change lever M4004 is rotated to the right direction, the paper gap change lever M4004 is latched and positioned by the other latch part. The paper gap change lever M4004 slides on an un-illustrated sliding face provided on the inner side of the carriage rail M4005 with a force of a weight of the carriage M4001.

An engagement part of the carriage M4001 that engages with the printing head cartridge H1000 is provided with a contact part E0011 as shown in FIG. 3. A pin on this contact part E0011 and an un-illustrated contact part (external signal input terminal) provided on the head cartridge H1000 contact with each other electrically, whereby transferring of various pieces of information for printing, supply of electric power to the ink discharge unit of the printing head cartridge H1000, and the like are performed. The contact part E0011 is attached to a carriage base plate E0013 (CRPCB, FIG. 3) mounted on a back face of the carriage M4001. The contact part E0011 is electrically pulled out to the side face part of the carriage M4001 using carriage flexible flat cable (carriage FFC) E0012, and connected to a main PCB E0014 (FIG. 3). An end of the carriage FFC E0012 near the main PCB E0014 is fixed to the chassis M3100 by an FFC clamp M4008, and is extended to a back side of the chassis M3100 through an un-illustrated hole provided in the chassis M3100 and connected to the main PCB E0014.

The carriage base plate E0013 is equipped with an encoder sensor E0004 (FIG. 3). Between both side faces of the chassis M3100, an encoder scale E0005 is laid across in parallel to the carriage shaft M4003. By detecting information on the encoder scale E0005 using the encoder sensor E0004, a moving position, a scanning speed, etc. of the carriage M4001 can be detected. For example, the encoder sensor E0004 is an optical transmission type sensor, and the encoder scale E0005 is printed on a film made of a resin, such as polyester, with shading parts and translucent parts printed alternately by a method of phototype process etc. The shading part is a portion for blocking light emitted from the encoder sensor E0004 and the translucent part is a portion for allowing the light to pass through.

The position of the carriage M4001 moving along the carriage shaft M4003 is detected relative to a reference (home position) at which the carriage M4001 is abutted to a right-side plate M3100*b* of the chassis M3100 provided on the end of a track of the carriage M4001. That is, after abutting the carriage M4001 against the right-side plate M3100*b*, the encoder sensor E0004 detects a pattern of the shading parts and the translucent parts formed on the encoder scale E0005 as the carriage M4001 moves. Then, by counting the number of detected patterns, the moving position of the carriage M4001 can be detected at any time.

Between an idler pulley M4009 and a carriage motor pulley M4010, a carriage belt M4011 is spanned substantially in parallel to the carriage shaft M4003, and the carriage M4001 is coupled under this carriage belt M4011. By rotating the carriage motor pulley M4010 using a carriage motor E0001, the carriage M4001 can be moved along the carriage shaft M4003.

(Restoration Unit)

Next, the restoration unit M5000 for performing restoration processing on the printing head cartridge H1000 will be explained.

The restoration unit M5000 in this embodiment is equipped with cleaning means for removing foreign substances adhering to an un-illustrated ink discharge unit in the printing head cartridge H1000, sucking means for normalizing an ink flow passage from the ink tank H1001 to the ink discharge unit, etc.

A cap M5001 is provided to oppose the ink discharge unit of the printing head cartridge H1000, and connected to a PG motor E0003 through an un-illustrated gear sequence and a cam mechanism to be movable in a direction of the arrow B in FIG. 2. When the printing head cartridge H1000 mounted on the carriage M4001 moves together with the carriage M4001 and stops at a position where its ink discharge unit opposes the cap M5001 (also called a "capping position"), the cap M5001 will move upwards vertically in FIG. 2. By this movement, the cap M5001 covers the ink discharge unit, resulting in a capping state. In this capping state, by operating an un-illustrated pump mechanism connected to the PG motor through a predetermined gear sequence, the ink is sucked and discharged from the ink tank H1001 passing through the ink discharge unit.

The restoration unit M5000 is equipped with a wiper blade M5002 as cleaning means for the ink discharge unit. The wiper blade M5002 is connected to the PG motor E0003 through a predetermined gear sequence, and is made movable in a C direction in the figure. After the carriage M4001 with the printing head cartridge H1000 mounted thereon is moved to a predetermined wiping position and stopped there, the wiper blade M5002 moves forwards in FIG. 2. By this movement, the wiper blade M5002 abuts the surface of the ink discharge unit of the printing head cartridge H1000, and cleanses the ink discharge unit.

(Electric Circuitry)

Figure 4:
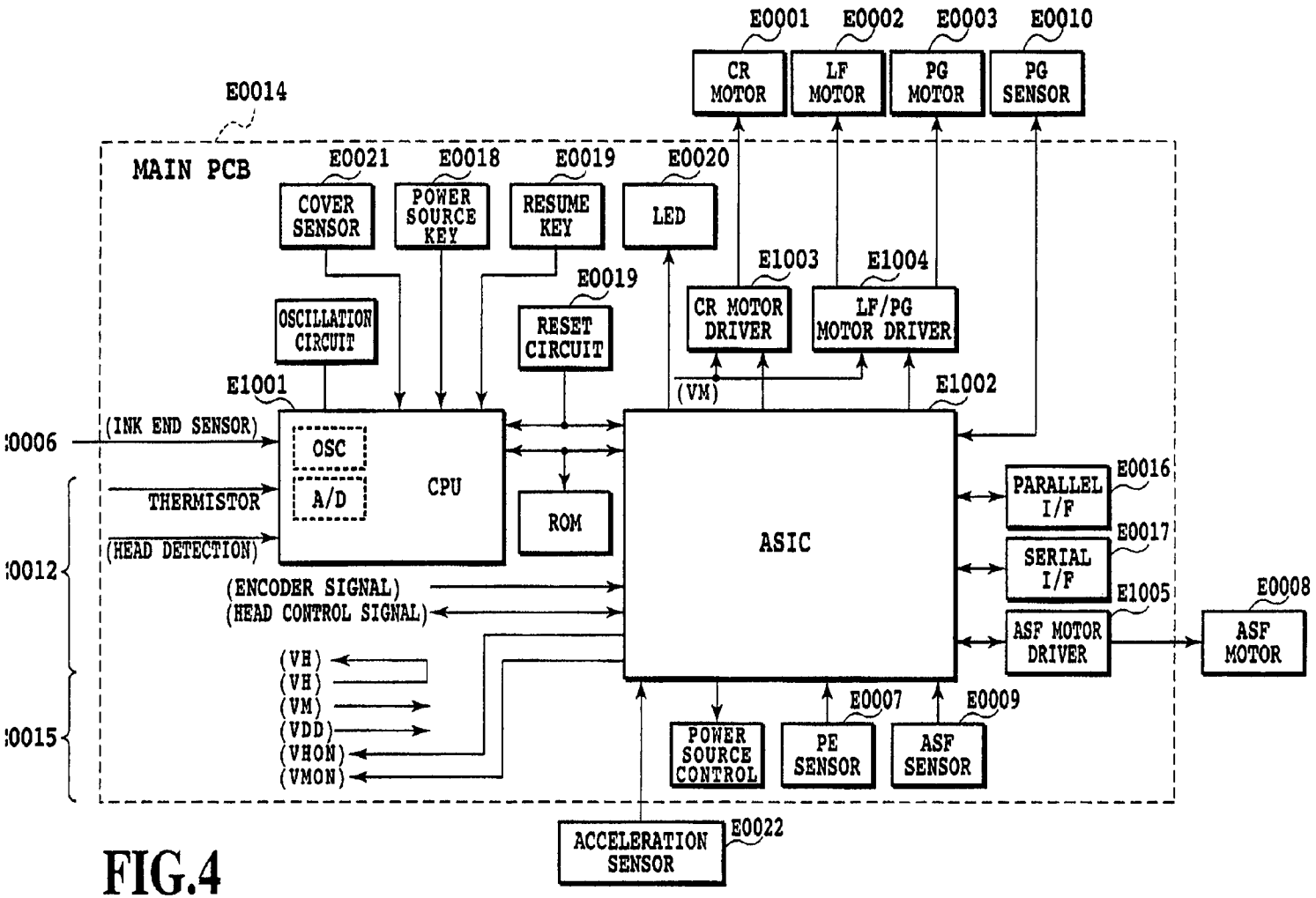
FIG. 4 is a block diagram of a main PCB in FIG. 3.

Next, electric circuitry in the embodiment of this invention will be explained. FIGS. 3 and 4 are outline block diagrams of the whole electric circuit in this embodiment.

The electric circuit in this embodiment is mainly constructed with the carriage base plate (CRPCB) E0013, the main PCB E0014, and a power source unit E0015, etc. The power source unit E0015 is connected to the main PCB E0014, supplying various drive electric powers.

The carriage base plate E0013 is mounted on the carriage M4001 (FIG. 2), and transfers signals between itself and the printing head cartridge H1000 through the contact part E0011. The carriage base plate E0013 detects a change in positional relation between the encoder scale E0005 and the encoder sensor E0004 based on a signal outputted from the encoder sensor E0004 with movement of the carriage M4001. The detected signal is outputted to the main PCB E0014 through the flexible flat cable (CRFFC) E0012.

The main PCB E0014 is a printed circuit board unit for managing drive control of several parts of the printing apparatus, and on its base plate there are provided I/O ports for a paper end detection sensor (PE sensor) E0007, an ASF sensor E0009, a cover sensor E0021, a parallel I/F E0016, a serial I/F E0017, the resume key E0019, the LED E0020, the power source key E0018, etc. Moreover, the main PCB E0014 is connected to the CR motor E0001, the LF motor E0002, the PG motor E0003, and an ASF motor E0008, performing drive control of these motors. Furthermore, the main PCB E0014 has an interface for connection with a PG sensor E0010, the CRFFC E0012, and the power source unit E0015.

A CPU E1001 performs a drive control of each part of the printing apparatus along with an ASIC (Application Specific Integrated Circuit) E1002. The CR motor E0001, the LF motor E0002, the PG motor E0003, and the ASF motor E0008 in the printing apparatus are controlled by a CR motor driver E1003, an LF motor driver E1004, and a PG motor driver E1004, and an ASF motor driver E1005, respectively, based on control signals of the CPU E1001.

(Outline of Operation)

Figure 5:
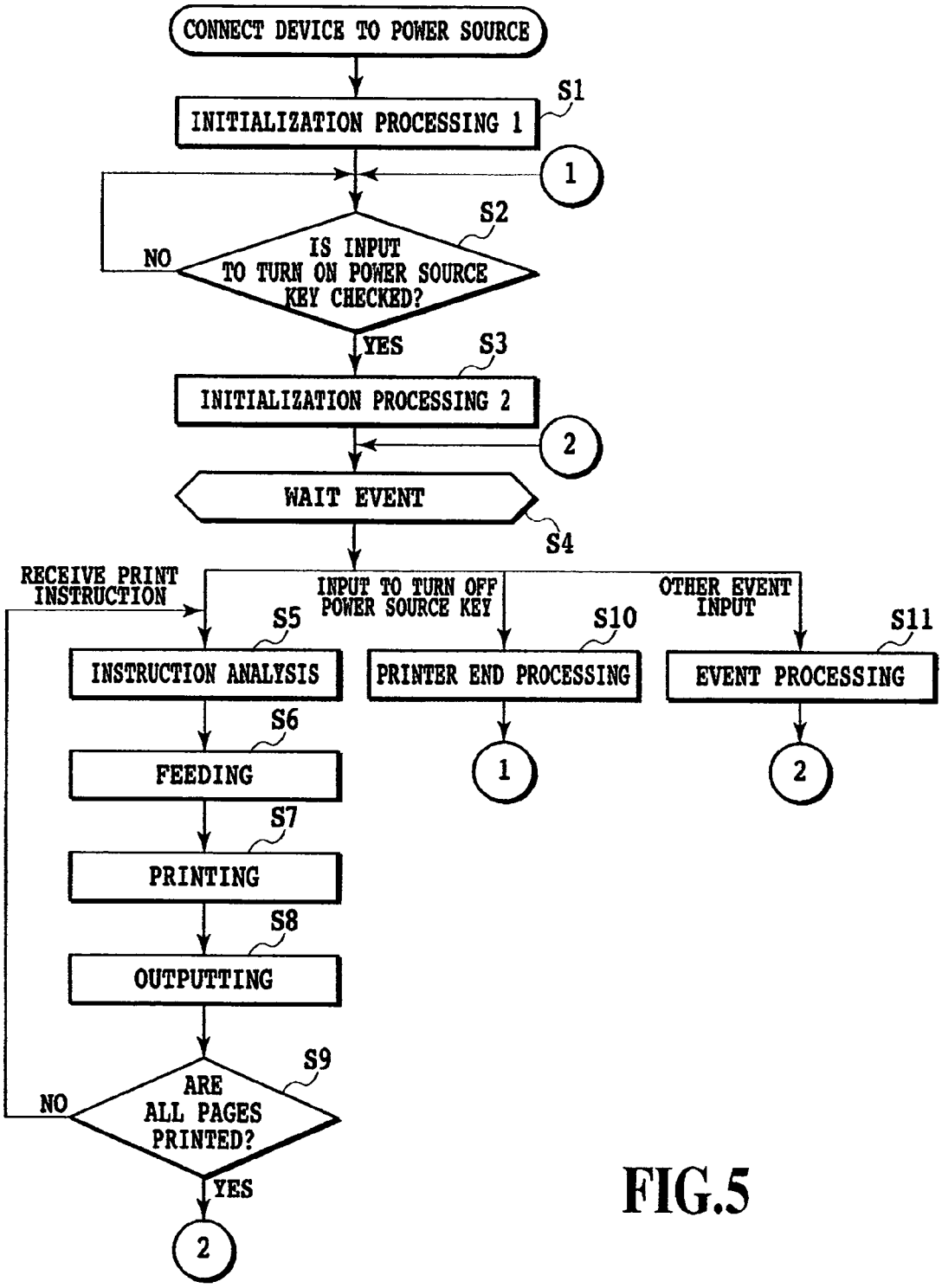
FIG. 5 is a flowchart for explaining the whole printing operation of the ink-jet printing apparatus in the first embodiment of this invention.

Next, an outline of operations of the printing apparatus in this embodiment will be explained based on a flowchart of FIG. 5.

When this printing apparatus (hereinafter referred to also as "this device") is connected to AC power source, first, first initialization processing (initialization processing 1) of this device is performed in Step S1. In this first initialization processing, an electric circuit system including ROM, RAM, etc. of this device is checked to make sure whether this device can electrically operate normally.

In the next Step S2, it is determined whether the power source key E0018 provided in the upper case M1002 of the device main body M1000 is turned on. When it is determined that the power source key E0018 is pressed to "on", the flow moves to the next Step S3, where second initialization processing (initialization processing 2) is performed. In this second initialization processing, drive mechanisms, a head cartridge, etc. of this device are checked. That is, in initializing each motor and reading head information, it is checked whether this, device can operate normally. An acquisition operation of home position information for determining a positional reference of the carriage is performed in this second initialization processing.

Event waiting is done in the next Step S4. That is, a command event to this device from an external I/F, a panel key event done by the user, an internal control event, etc. are monitored; when any one of these events occurs, processing corresponding to the event will be executed. For example, when in Step S4, a print command event from the external I/F is received, the flow moves to Step S5. Moreover, when the power source key event by the user occurs in the same Step S4, the flow moves to Step S10. When the other event occurs, the flow moves to Step S11.

In Step S5, a print command from the external I/F is analyzed, and a specified paper type, a paper size, printing quality, a feeding method, etc. are determined. Then, data indicating the determination result is stored in the RAM in this device, and the flow proceeds to Step S6. In the next Step S6, paper feeding is started by a paper feeding method specified in Step S5, and after a leaf of the paper form is conveyed to a print start position, the flow proceeds to Step S7.

In the next Step S7, the printing operation is performed. In this printing operation, print data transmitted from the external I/F is temporarily stored in a print buffer. Subsequently, the carriage M4001 starts to be moved in the scanning direction by driving the CR motor E0001, and the print data stored in the print buffer is supplied to the printing head cartridge H1000, whereby printing of one line is performed. When this printing of one line is completed, the paper form is conveyed by a predetermined amount in the sub-scanning direction by rotating the LF roller M3001 by the LF motor E0002. Then, the printing operation and the conveyance operation of the paper form like this are repeated. Finally, when printing of the print data of one page transmitted from the external I/F is completed, the flow proceeds to Step S8.

In Step S8, an un-illustrated paper output roller is driven by the LF motor E0002; paper feeding is repeated until it is determined that the paper form has been outputted completely. At the time when the paper feeding is completed, the printer comes to a state where the paper form has been outputted on the output tray M1004*a* completely.

In the next Step S9, it is determined whether the printing operation of all pages to be printed is completed. When the page to be printed is remaining, the flow returns to Step S5, where the operations of Steps S5 to S9 are repeated. When the printing operation of the pages to be printed is completed, the flow moves to Step S4 after the completion of the printing operation, waiting the next event.

On the other hand, in Step S10, printer end processing is performed to halt operations of this device. That is, in order to disconnect the power source of various motors, the head, etc., the power source is disconnected after the printer has moved to a state where disconnection of the power source is possible. Then, the flow proceeds to Step S4.

In Step S11, event processing other than the above is performed. For example, processing that corresponds to restoration processing commands of the printing head from various panel keys of this device and the external I/F, processing that corresponds to restoration events generated internally, etc. are performed. After completion of this processing, the flow proceeds to Step S4, waiting the next event.

(Example of Control of Carriage)

Next, feedback controls as an example of control of the carriage motor E0001 and the carriage M4001 will be explained with reference to FIGS. 6 and 7. The carriage motor E0001 that is a drive source of the carriage M4001 is driven by a CR motor control signal from the ASIC E1002.

Figure 6:
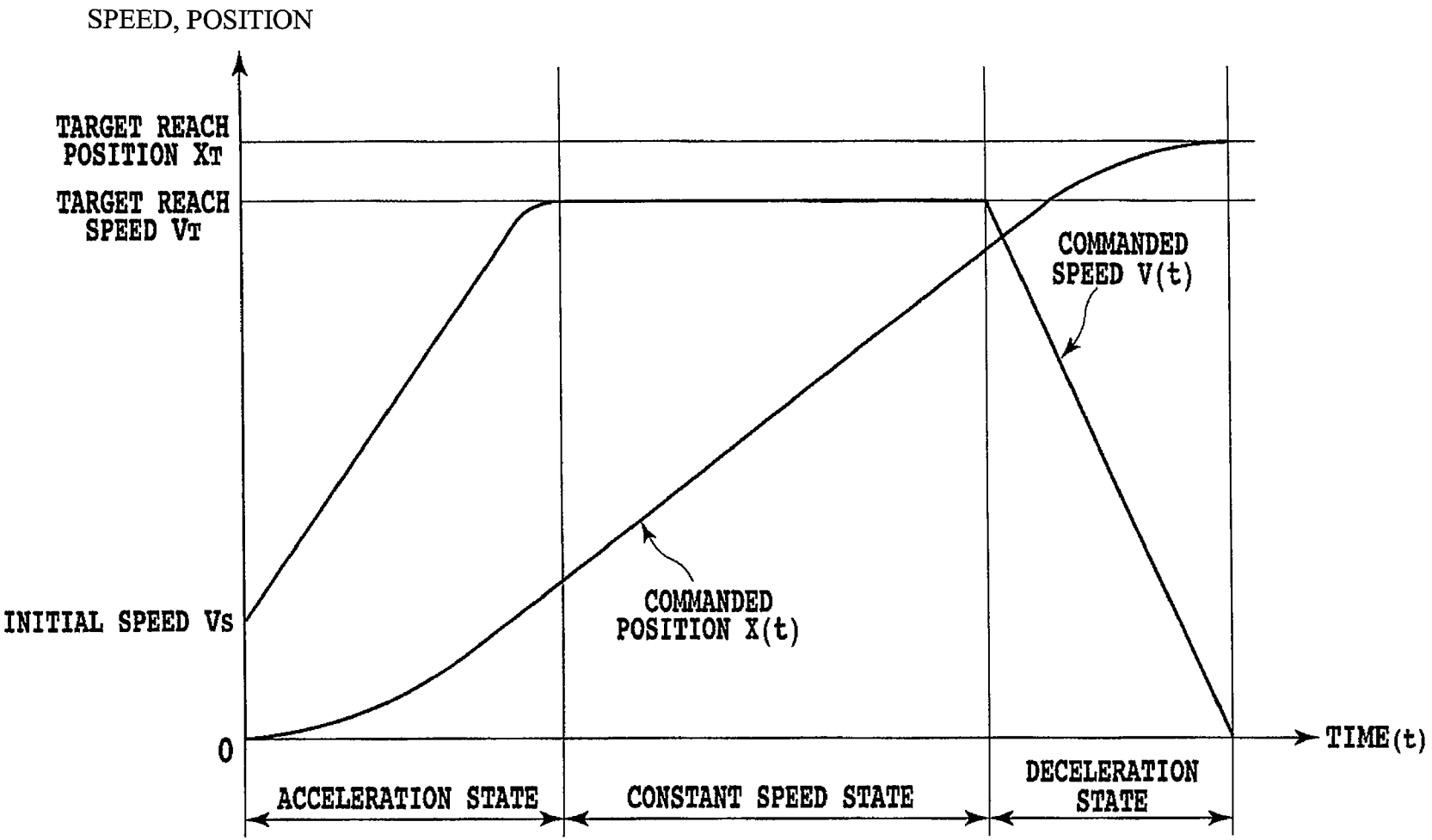
FIG. 6 is a diagram for illustrating a control mode of the carriage of the ink-jet printing apparatus in the first embodiment of this invention.

FIG. 6 shows a diagram showing a change in a commanded speed and a commanded position of the carriage M4001 in feedback processing, which will be described later. A driving state of the carriage M4001 is roughly divided into three states: an acceleration state, a constant speed state, and a deceleration state. The acceleration state is a state where the carriage is accelerated to a predetermined constant speed from a stop state. The constant speed sate is a state where ink drop is discharged from the ink discharging unit of the printing head cartridge H1000 mounted on the carriage M4001 to perform printing on printing sheet guided by the platen M3001 of the printing apparatus. The deceleration state is a state where the carriage M4001 is decelerated to stop at a predetermined position. In the case of this example, the commanded speed V(t) in the acceleration state increases with time.

The CPU E1001 performs various processing for moving the carriage M4001. For example, processing is executed periodically at every predetermined timing of 1 ms intervals; at each timing, the commanded speed V(t) and the commanded position X(t) are computed. In FIG. 6, a time of the acceleration state is denoted as an acceleration time, and a time of the deceleration state is denoted as a deceleration time. Further, a commanded position that the carriage M4001 must reach finally by a single movement is denoted specially as a target reach position XT, and a moving speed (scanning speed) at the constant speed state is denoted as a target reach speed VT.

Figure 7:
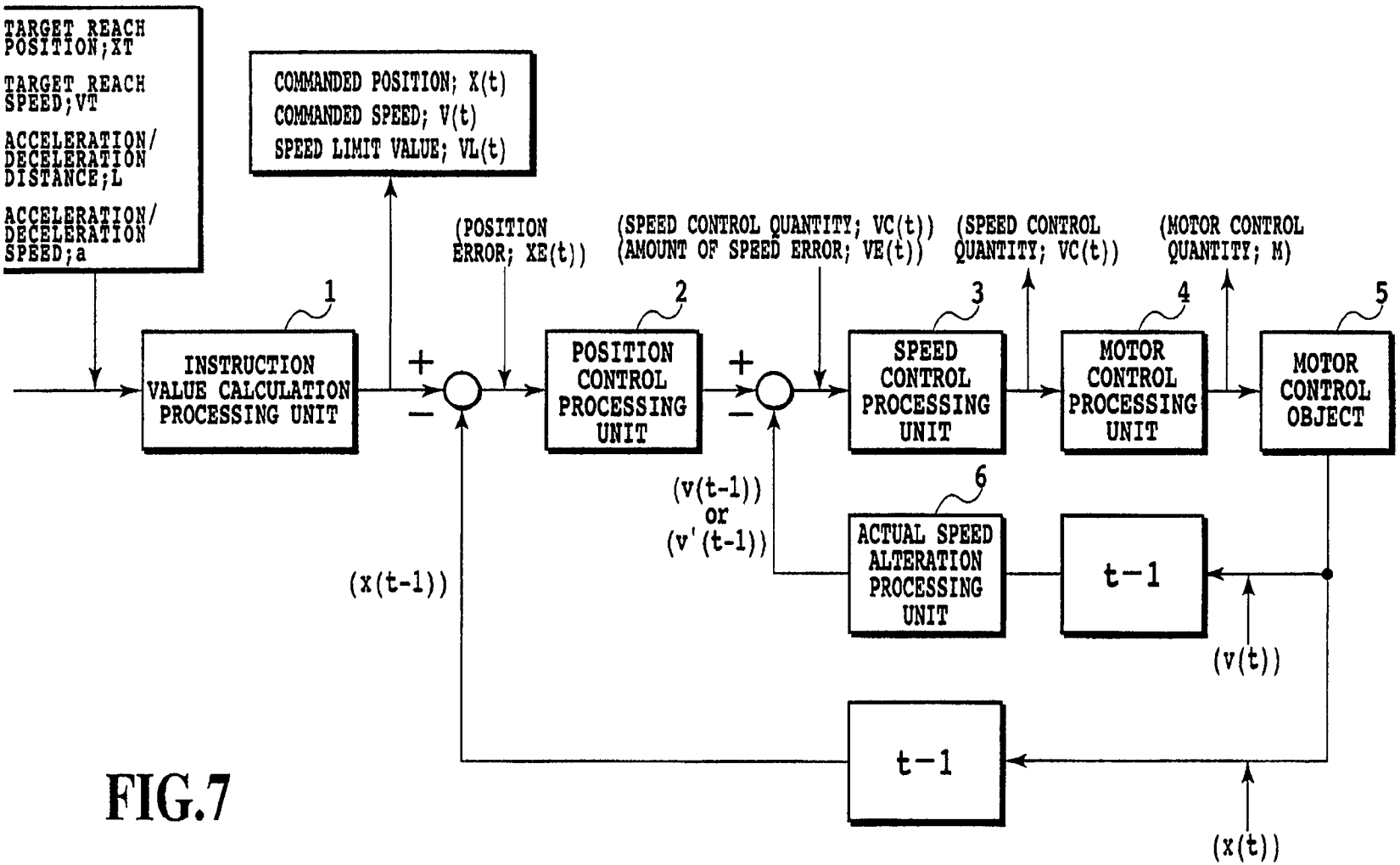
FIG. 7 is a diagram for illustrating a feedback control mode of the carriage of the ink-jet printing apparatus in the first embodiment of this invention.

FIG. 7 is an explanatory drawing of a feedback control system of the carriage motor E0001 and the carriage M4001.

As shown in FIG. 7, the carriage M4001 is feedback-controlled based on the moving speed and the position information. In the case of this example, this processing in FIG. 7 is performed every 1 ms. In FIG. 7, a variable (t) indicates a time of present processing timing, and a variable (t−1) indicates a time of previous processing timing (in this case, a state earlier by 1 ms). The processing system of this example is mainly constructed with a command value calculation processing unit 1, a positional control processing unit 2, a speed control processing unit 3, a motor control processing unit 4, and a control target 5.

The command value calculation processing unit 1 computes command values of the speed and the position of the carriage M4001 at every predetermined timing (in this example, 1 ms). The positional control processing unit 2 computes a control quantity based on a difference between the commanded position X(t) of the carriage M4001 and an actual position X(t−1) of the carriage M4001, namely position error XE(t). The speed control processing unit 3 computes a control quantity based on a difference between the commanded speed V(t) of the carriage M4001 and an actual speed V(t−1) of the carriage M4001, namely speed error VE(t) etc. The motor control processing unit 4 converts the computed values computed by the positional control processing unit 2 and the speed control processing unit 3 to a motor control quantity M fitted to an input of the CR motor driver E1003. The CR motor driver E1003 controls the carriage motor E0001 that is a drive source of the carriage M4001, and makes it generate a driving force. The control target 5 includes a motor whose driving is controlled based on the motor control quantity M computed by the motor control processing unit 4, the carriage connected to this etc.

The motor control quantity M is proportional to the driving force that the motor generates; the motor generates larger driving force with increasing motor control quantity M. In this example, information of the position and speed of the carriage M4001 is detected using the encoder sensor E0004 and the encoder scale E0005, and the detected information is stored in un-illustrated DRAM provided inside the ASIC E1002 at any time. The CPU E1001 acquires the stored information at each processing timing of the feedback control.

(Control for Vibration Prevention)

Figure 9:
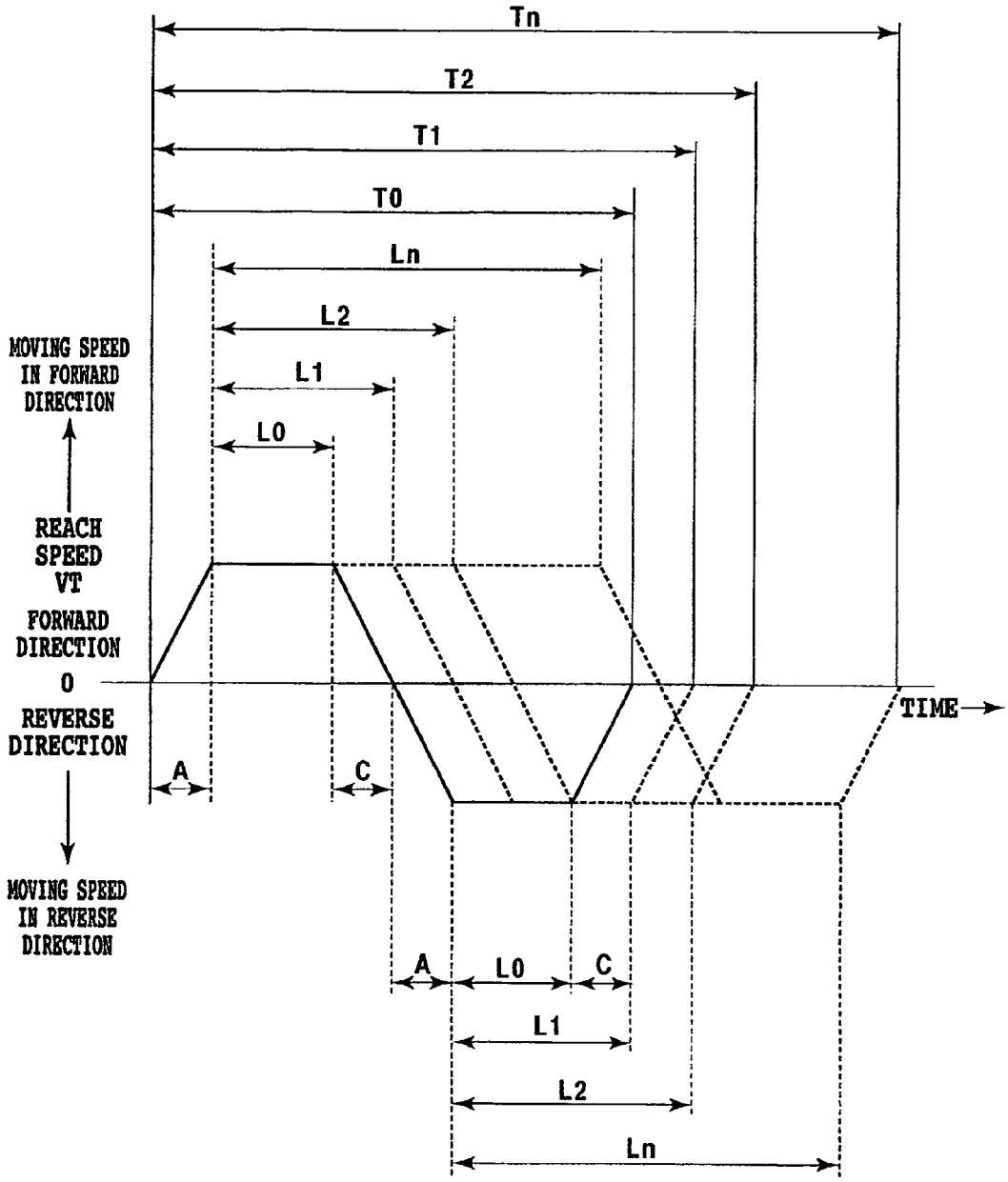
FIG. 9 is a diagram for illustrating a moving mode of the carriage of the ink-jet printing apparatus in the first embodiment of this invention.

Next, a control for vibration prevention based on such processing of FIG. 7 of the printing apparatus in this example will be explained with reference to FIGS. 8, 9, and 10.

In the case of this example, the control for vibration prevention comprises first, second, and third processing. The first processing is processing for detecting one round-trip period of the carriage when vibration of a table, rack, or the like on which the printing apparatus is installed becomes a minimum by making the carriage of the printing apparatus operate a reciprocating movement. The second processing is processing for determining one round-trip time at the time of an actual printing scanning based on one round-trip period detected in the first processing and printing information transmitted from host equipment, such as a personal computer. The third processing is processing for performing actual printing based on the one round-trip time determined by the second processing.

Hereafter, the first, second, and third processing will be explained.

(First Processing)

First, the first processing for detecting one round-trip period of the carriage when vibration of a table, rack, or the like becomes a minimum by making the carriage make a reciprocating movement based on different sets of drive conditions.

The first processing is processing in a measurement mode of one round-trip period of the carriage when the vibration of a table, rack, or the like becomes a minimum. That is, by each of different sets of drive conditions as shown in FIG. 8, the carriage M4001 is made to make a predetermined number of reciprocating movements and the vibration generated at the time of the reciprocating movements is measured by an acceleration sensor E0022. Then, a set of drive conditions of the carriage M4001 by which the measurement value becomes not larger than a predetermined value of acceleration is detected.

FIG. 8 shows tables (table number 0, 1, 2, 3, . . . n) for storing different sets of drive conditions used for moving the carriage M4001. Each table of this example stores a constant-speed distance, an acceleration time, a constant-speed time, a deceleration time, and a moving distance. The constant-speed distance is a distance Ln (n=0, 1, 2, 3 . . . ) for which the carriage is moved at a constant speed VT, and the acceleration time is a time A required to accelerate the carriage from a stop state to the constant speed VT. The constant-speed time is a time Bn (n=0, 1, 2, 3, . . . ) required to move the cartage for a constant-speed distance Ln at a constant speed VT, and the deceleration time is a time C required to decelerate the carriage from the constant speed VT to make stop. The moving distance is a distance Dn (n=0, 1, 2, 3, . . . ) for which the carriage moves by these drive conditions: Ln, A, Bn, and C. The constant speed VT is equal to a target reach speed VT in FIGS. 6 and 7, being set as a fixed value.

In this example, the acceleration time A and the deceleration time C are set as fixed values, and constant-speed distances Ln (n=0, 1, 2, 3, . . . ) are set to become large stepwise by a predetermined distant 1. Accordingly, the larger the each table number, the longer the one round-trip period (one round-trip time) of the carriage becomes.

For example, setting the acceleration time A and the deceleration time C both to 70 ms, the constant scanning speed VT to 400 mm/s, and the predetermined distance l to 5 mm, 40 tables as shown in FIG. 8 (Table number: 0, 1, 2, 3, . . . 39) are prepared. Moreover, for example, the number of reciprocating movements of the carriage M4001 by a set of drive conditions of each table is set to three times. Therefore, when the carriage M4001 is made to make a reciprocating movement by a set of drive conditions of each table, the time (period) required for the carriage M4001 to make one-round trip Tn (n:

0, 1, 2, 3, . . . 39) is about 300 ms (milliseconds) to about 1.3 s (seconds), increasing by about 25 ms when moving to a subsequent table.

More specifically, as is clear from FIG. 9, when the carriage is made to make a reciprocating movement by the set of drive conditions of the Table number 0, the time required for the one reciprocating movement T0 is found by an formula {A+B0+C)×2} as follows:

$$T0=\{(70\ (\text{ms})+(5\ (\text{mm})/400\ (\text{mm/s}))+70\ (\text{ms})\}\times 2\cong 300\ (\text{ms})$$

Similarly, when the carriage is made to make a reciprocating movement by the set of drive conditions of the Table number "39," the time required for the one reciprocating movement T39 is found as follows:

$$T39=\{(70\ (\text{ms})+(5\ (\text{mm})\times 40)/400\ (\text{mm/s}))+70\ (\text{ms})\}\times 2\cong 1.3\ (\text{s})$$

Figure 10:
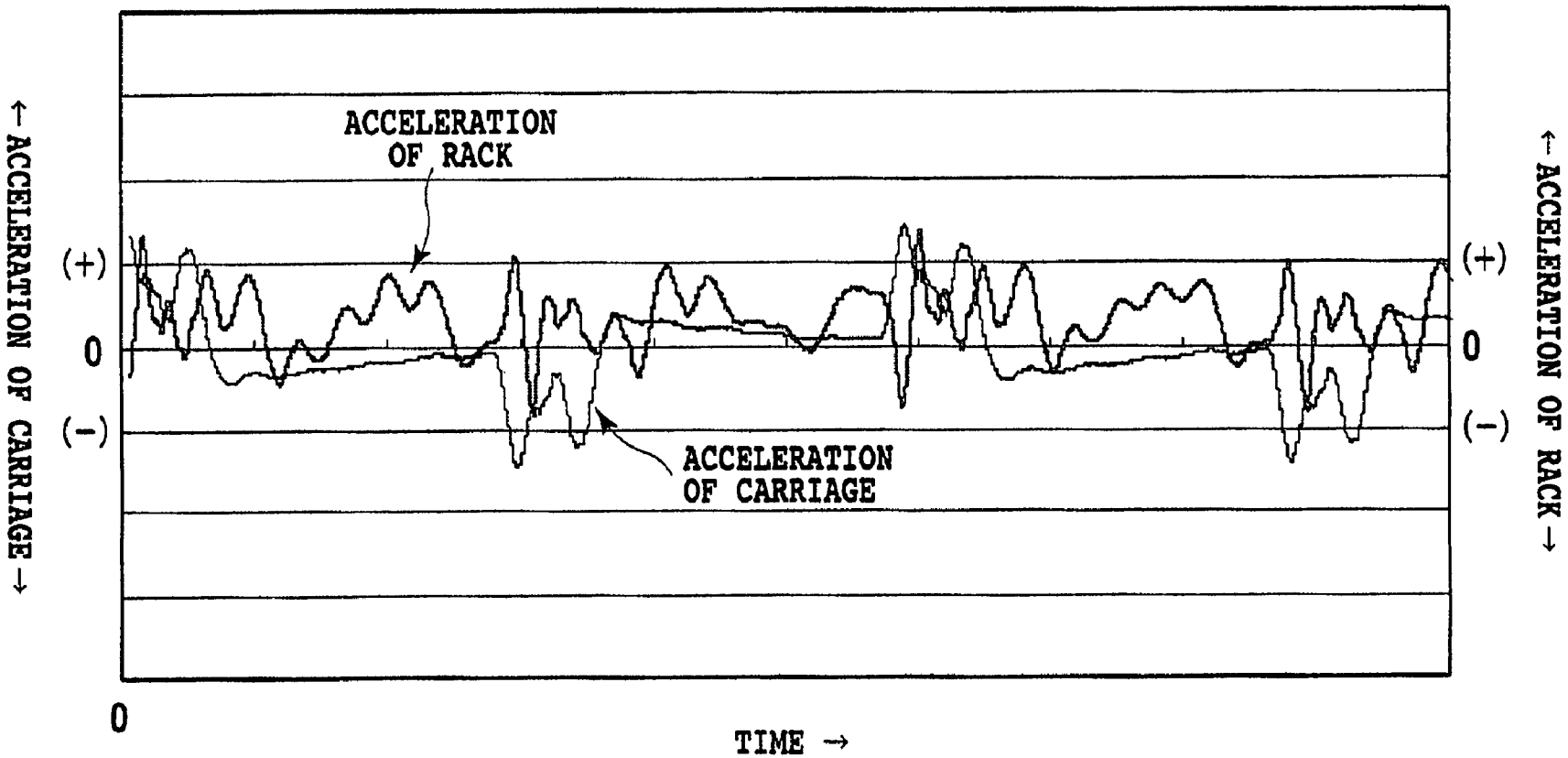
FIG. 10 is a diagram for illustrating a change in the acceleration when vibration of a table, rack, or the like becomes small in the first embodiment of this invention.
Figure 11:
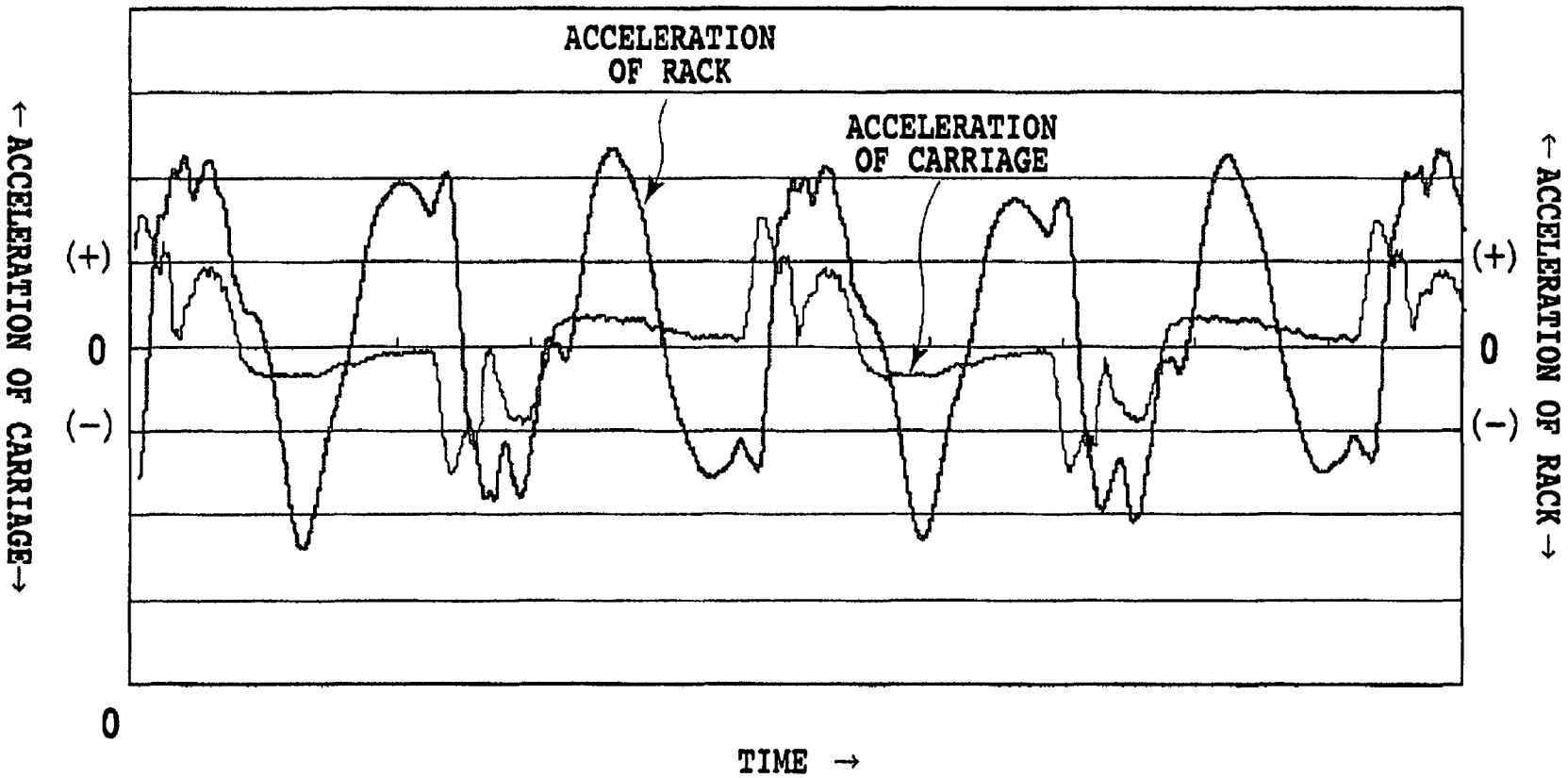
FIG. 11 is a diagram for illustrating a change in the acceleration when the vibration of the table, rack, or the like becomes resonant with scanning of the carriage.

When the printing apparatus is installed on a table, rack, or the like and the carriage M4001 is made to make a reciprocating movement by several sets of drive conditions as shown in FIG. 8, the acceleration of the carriage and the acceleration of the table or rack vary as shown in FIGS. 10 and 11.

In these FIGS. 10 and 11, the natural frequency of vibration of the rack on which the printing apparatus is installed is about 3.4 Hz (natural period: 294 ms). The printing apparatus was installed in that rack and the carriage M4001 was made to make a reciprocating movement. In these figures, the scales of the horizontal axes are the same and the scales of the vertical axes are the same. In the case of FIG. 10, as a set of drive conditions of the carriage, the acceleration time A, the deceleration time C, the constant-speed distance Ln, and the constant speed VT are set to 70 ms, 70 ms, 180 mm, and 400 mm/s, respectively. The one round-trip time of the carriage M4001 by this set of drive conditions is about 1.18 s. In the case of FIG. 11, the acceleration time A, the deceleration time C, the constant-speed distance Ln, and the constant speed VT are set to 70 ms, 70 ms, 120 mm, and 400 mm/s, respectively. The one round-trip time of the carriage M4001 at this time is about 0.88 s.

In the case of FIG. 11, the rack fell in a resonant relationship where it vibrates synchronously with the reciprocating movements of the carriage M4001. At this time, the rack on which the printing apparatus is installed swings largely at a natural frequency of 3.4 Hz. On the other hand, in the case of FIG. 10, the rack was not synchronous with the reciprocating movement of the carriage M4001, showing a vibration state with a small amplitude. At this time, the rack becomes a state where the swing can hardly be sensed. In FIG. 10, the period of one round trip of the carriage M4001 is four times larger than the natural period of the rack; in FIG. 11, the period of one round trip of the carriage M4001 is three times larger than the natural period of the rack.

In addition, as a set of drive conditions of the carriage M4001, setting the acceleration time A, the deceleration time C, the constant-speed scanning distance Ln, and the constant speed to 70 ms, 70 ms, 60 mm, and 400 mm/s, the carriage M4001 is made to make a reciprocating movement so that its period of one around trip becomes about 0.58 s. Also in this case, the rack shows a small vibration state like the case of FIG. 10. At this time, the period of one round trip of the carriage M4001 becomes twice the natural period of the rack.

Thus, there are two sets of drive conditions that control the vibration of the table or rack to be small among several sets (combinations) of drive conditions of the carriage M4001 as shown in FIG. 8. That is, in the case where the natural frequency of a table or rack on which the printing apparatus is installed is in the range of 3.2 Hz to 6.5 Hz, as described above, there exist two sets of drive conditions that can minimize the vibration of the table, rack, or the like when the carriage M4001 is made to make a reciprocating movement under 40 sets of drive conditions where the acceleration time A, deceleration time C, the constant speed VT, and the predetermined distance l are set to 70 ms, 70 ms, 400 mm/s, and 5 mm, respectively.

Figure 12:
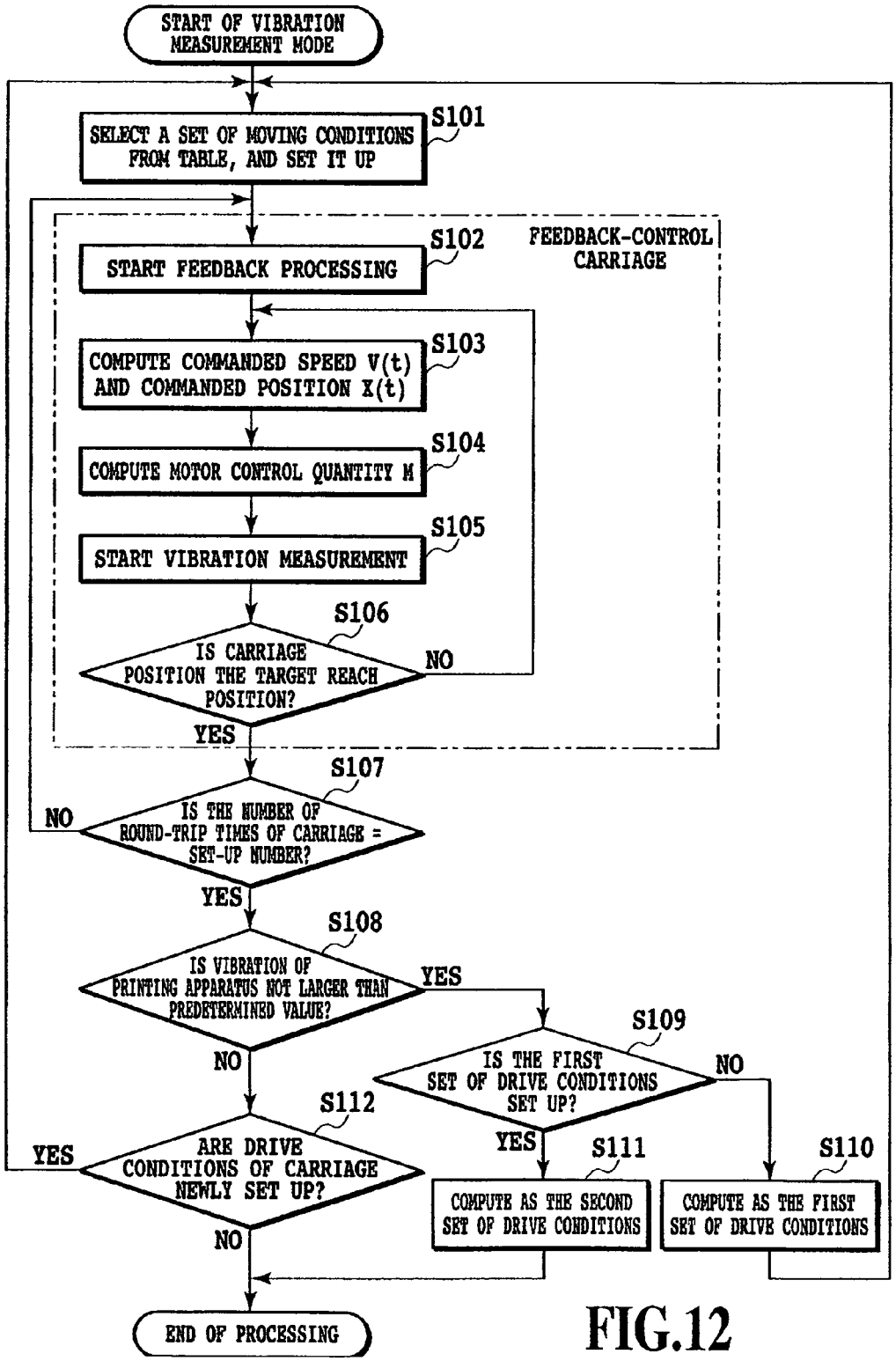
FIG. 12 is a flowchart for explaining measurement processing of the vibration in the first embodiment of this invention.

FIG. 12 is a flowchart explaining processing for selecting drive conditions of the carriage M4001 when the vibration of the table, rack, or the like on which the printing apparatus is installed becomes a minimum by making the carriage M4001 make a reciprocating movement based on drive conditions as described above. In the case of this example, selection processing of such drive conditions is carried out by the user instructing the printing apparatus by means of a printer driver on the host equipment, such as a personal computer, connected to the printing apparatus.

When the user instructed start of the processing, first the carriage M4001 moves to a substantially central part in the scanning direction, as shown in FIG. 2, and starts the selection processing of drive conditions of the cartridge that realize minimum vibration.

First, in Step S101, the table number "0" of FIG. 8 is selected as a set of drive conditions of the carriage, and set up as a first set of drive conditions of the carriage M4001. That is, the conditions are set as follows: the acceleration time A and the deceleration time C are both 70 ms; the scanning distance L0 at the constant speed VT is 5 mm; and the constant speed VT of the carriage M4001 is 400 mm/s. In the next Step S102, a feedback control as shown in FIG. 7 is started based on the set of drive conditions thus set up.

When this feedback control is started, the command value calculation processing unit 1 of FIG. 7 computes the commanded speed V(t) and the commanded position X(t) that the carriage M4001 must reach based on the set of drive conditions of the carriage M4001 set up in Step S101 at each feed back processing timing (Step S103). The motor control processing unit 4 of FIG. 7 computes the motor control quantity M for driving the carriage motor E0001 based on these computed values (Step S104). Thereby, the movement of the carriage M4001 is started. When the movement of the carriage M4001 is started, acceleration measurement of vibration by the acceleration sensor E0022 will be started in Step S105.

In the next Step S106, it is determined whether the carriage M4001 has reached the target position XT to be reached. The target reach position XT is set at a position away from the substantially central part in the scanning direction described above by a half of the distance D0 in the forward direction of the carriage. The distance D0 is a distance obtained by summing up following: a distance that the carriage M4001 moves in the acceleration time A; the constant-speed distance L0, and a distance that the carriage M4001 moves in the deceleration time C. In this example, since the table number "0" is selected, the target reach position XT becomes a position away from the central part of the printing apparatus (substantially central part in the scanning direction) by 16.5 mm in the forward direction. In the case of this example, the moving distances of the carriage in the acceleration time A and in the deceleration time C are both 14 mm.

In this step S106, if the carriage M4001 is determined to have reached the target reach position XT, the flow proceeds to Step S107, where it is determined whether the number of reciprocating movements of the carriage M4001 reached a previously set number. In this example, the number of reciprocating movements is set to three times. If the number of reciprocating movements of the carriage M4001 have not reached three times in the determination in Step S107, the flow goes back to Step S102, where the commanded speed V(t) and the commanded position X(t) are newly set up. At this time, the target reach position XT of the carriage M4001 is set at a position away from the central part of the printing apparatus (substantially central part in the scanning direction) by a half of the distance D0 in the reverse direction of the carriage. Here, since the table number "0" is selected as in the previous case, the target reach position XT becomes a position away from the central part of the printing apparatus by 16.5 mm in the reverse direction.

Then, the flow moves to Step S104, and accordingly the carriage M4001 will be moved in the reverse direction. Then, when the carriage M4001 reached the target reach position XT, it is determined whether the number of reciprocating movements of the carriage M4001 reached the previously set number again in Step S107.

Such processing of Steps S102 to S107 is repeated until the number of reciprocating movements of the carriage M4001 reaches the previously set number. Therefore, when the table number "0" is selected, the carriage will make a reciprocating movement between a position away from the central part of the printing apparatus by 16.5 mm in the forward direction and a position away from the central part thereof by 16.5 mm in the reverse direction.

When the number of reciprocating movements of the carriage M4001 reached the previously set number, the acceleration measurement of the vibration by the acceleration sensor E0022 is stopped temporarily and the flow moves to the next Step S108. In this Step S108, it is determined whether a measurement result of the acceleration in the previous Step S105 is with in a predetermined value. In the case of this example, the predetermined value is set to 0.3 $m/s^2$. If the measurement result of acceleration is not larger than this predetermined value, vibration of a table, rack, or the like is small and the installed devices placed on it, such as a personal computer, is in a state where the vibration causes no trouble for use. The acceleration measurement of vibration is carried out at every timing of the feedback processing of the carriage. In the case of this example, it is done at every 1 ms.

If the measurement result of vibration is larger than the predetermined value in the determination in Step S108, the flow moves to Step S112, where it is determined whether a set of drive conditions of the carriage M4001 should be newly set. If it is determined that it should be set newly, the flow goes buck to Step S101. In the case of this example, if the measurement result of vibration is larger than the predetermined value, the sets of drive conditions of the tables as shown in FIG. 8 are set sequentially in numeric order of the tables. Therefore, here the flow goes back to Step S101, where a set of drive conditions of the next table number "1" will be set up.

Thus, the magnitude of the vibration of the printing apparatus is monitored in Step S108 while the carriage M4001 is made to make a reciprocating movement for predetermined numbers according to the set of drive conditions of the carriage M4001 as shown in FIG. 8.

If the magnitude of the vibration of the printing apparatus is determined to be not larger than the predetermined value in Step S108, the flow moves to Step S109, where it is determined whether the magnitude of the vibration of the printing apparatus comes to be not larger than the predetermined value for the first time, that is, whether the first set of drive conditions described later has already been set up. When the vibration of the printing apparatus becomes not larger than the predetermined value this time for the first time, the set of drive conditions of the carriage M4001 at that time is designated as the first set of drive conditions of the carriage M4001. Then, a moving distance Dn corresponding to the table number of the first set of drive conditions is designated as a first moving distance Dn1 and retained. After this, the flow goes back to Step S101 again, where the next set of drive conditions is set up based on the table shown in FIG. 8 and the reciprocating movement of the carriage M4001 is started.

Subsequently, similarly in Step S108, the magnitude of the vibration of the printing apparatus is monitored, the carriage M4001 is made to make a reciprocating movement while a set of drive conditions is varied until the vibration becomes not larger than the predetermined value. If in Step S108, the magnitude of the vibration of the printing apparatus becomes not larger than the predetermined value again, the flow moves to Step S109, where it is determined whether the first set of drive conditions is set up. Here, since the first set of drive conditions is already setup, the flow moves to Step S111, where a set of drive conditions of the carriage M4001 at that time is designated as a second set of drive conditions. Then, a moving distance Dn corresponding to the table number of the second set of drive conditions is designated as a second moving distance Dn2 and retained.

In this way, two sets of drive conditions of the carriage M4001 under each of which the magnitude of vibration of a table, rack, etc. on which the printing apparatus is installed becomes not larger than the predetermined value are detected, moving distances at these sets of drive conditions are set as first and second moving distances Dn1, Dn2, and the processing of FIG. 12 is ended.

(Second and Third Processing)

Figure 13:
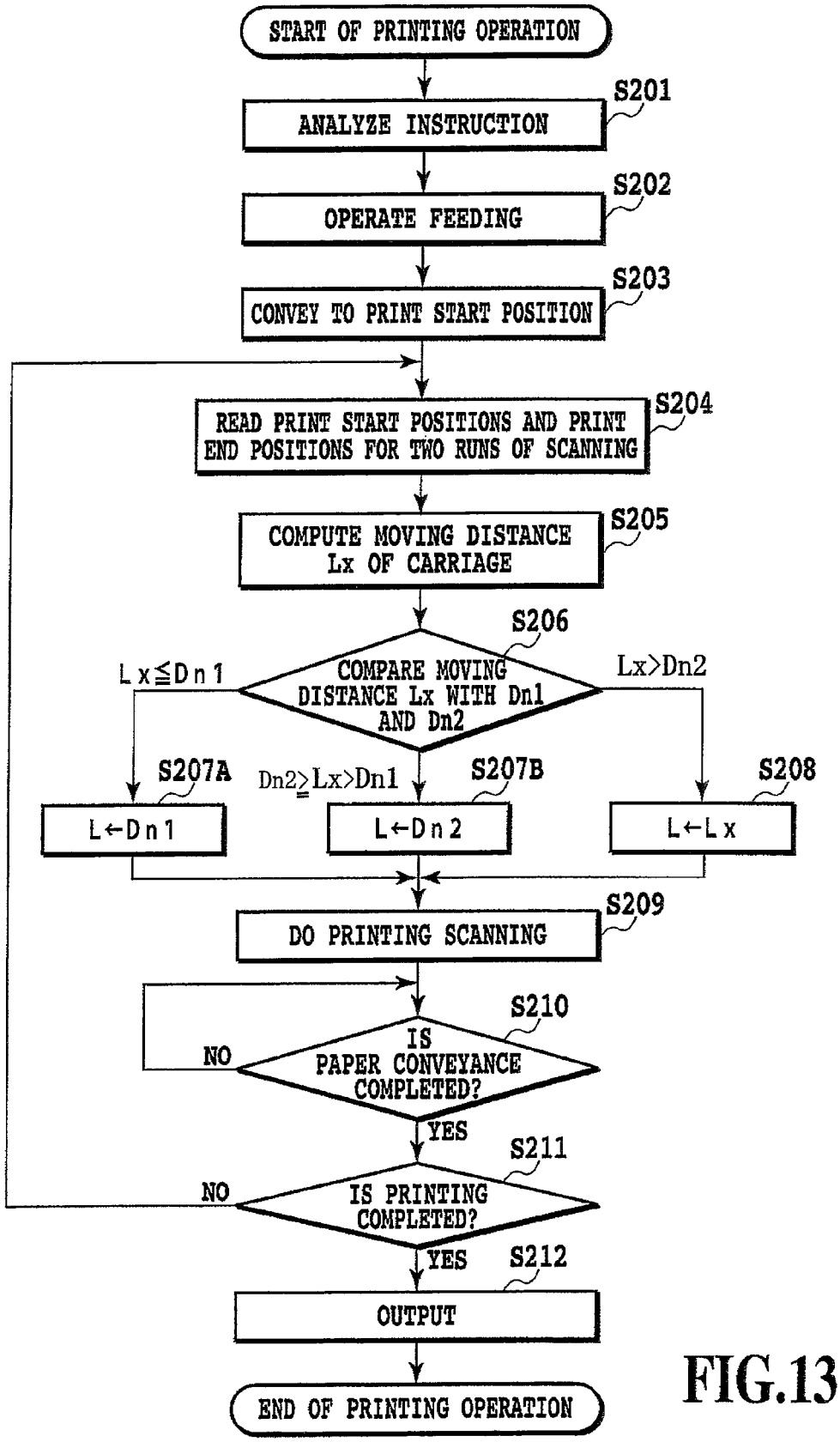
FIG. 13 is a flowchart for explaining a printing operation in the first embodiment of this invention.

Next, processing for performing a desired printing operation based the two sets of drive conditions of the carriage M4001 thus detected will be explained based on the flowchart of FIG. 13.

First, the print command is analyzed in Step S201. The print command is transmitted to the printing apparatus from the host equipment, such as a personal computer, connected to the printing apparatus through the parallel I/F E0016 or the serial I/F E0017 in FIG. 4 in order for the printing apparatus to perform desired printing. In Step S201, based on this print command, the following are analyzed: specified paper form type, a paper form size, printing quality, a paper feeding method including a method for driving the automatic feeding unit M2000 shown in FIG. 2, etc. Information of those analysis results is temporarily stored in RAM inside the printing apparatus.

Next, the flow moves to Step S202, where the automatic feeding unit M2000 is driven, based on the paper feeding method specified previously, to perform a feeding operation. Subsequently, the LF roller M3001 of FIG. 2 is driven in Step S2003 to convey paper form to a start position of printing (print start position). The print start position is a position where the paper form opposes to an un-illustrated ink discharge unit of the head cartridge H1000 mounted on the carriage M4001.

Next, the flow moves to Step S204, where the print data transmitted from the external I/F is temporarily stored in an un-illustrated print buffer. Further, based on the print data stored in the print buffer, a print start position and a print end position of the print data to be printed by two runs of scanning of the carriage M4001 are computed. That is, the print start position and the print end position of the print data to be printed by a first-run scanning in one direction and the print start position and the print end position of the print data to be printed by a subsequent second-run scanning in the other direction are computed. In the case of this example, as described above, the printing operation can be performed in the one direction and in the other direction of the carriage (two-way printing). The un-illustrated print buffer is capable of storing data quantity to be printed at the time of the two-run movements of the carriage M4001. After the print data is printed by the first-run scanning, the print data to be printed by third-run scanning will be stored instead of that print data. That is, the print data that now will be printed sequentially by two runs of scanning are stored in the print buffer. The print data is assigned print position on the printing paper according to a storing position in the print buffer. Since the print start position and the print end position are computed based on the print data for each single-run scanning, here as described above, two sets of print start positions and the print end positions corresponding to two runs of scanning are computed.

In the next Step S205, based on the print start positions and the print end positions for two runs of scanning thus computed, the moving distances Lx of the carriage at the time of the printing scanning in the previous time are computed.

Figure 14:
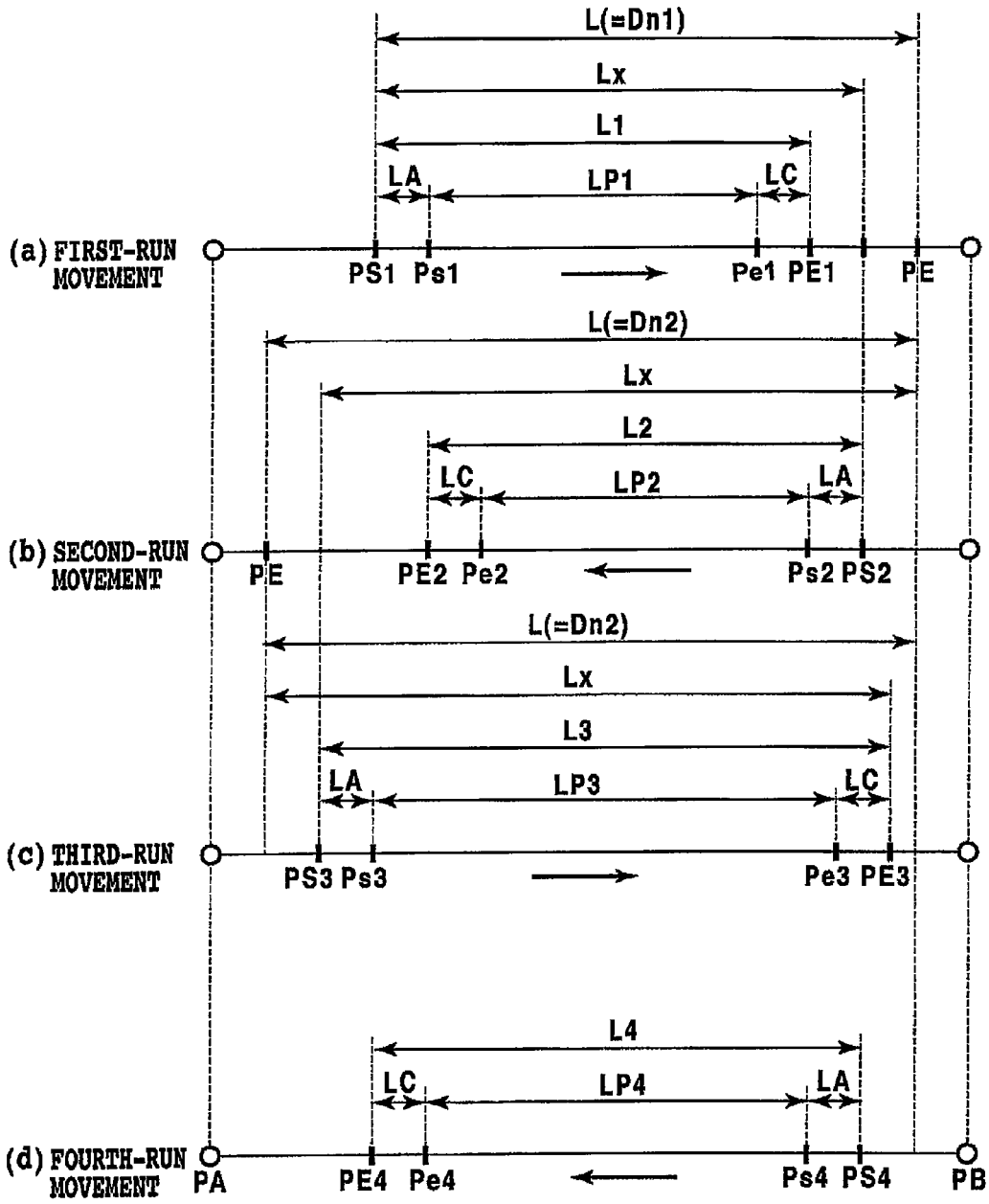
FIG. 14 is a diagram for illustrating an example of setting of a moving distance of the carriage in the first embodiment of this invention.

FIG. 14 is a diagram for explaining one example of a calculation method of the moving distance Lx. PA and PB denote movement limit positions and the movement limit position PA is also called an origin position. Between these positions PA, PB, the carriage moves rightwards in odd-number runs and moves leftwards in even-number runs. Ps1 and Pe1 denote the first-run print start position and the first-run print end position, respectively. Ps2 and Pe2 denote the second-run print start position and the second-run print end position, respectively.

First, the first-run moving distance Lx of the carriage is computed as follows.

From the first-run print start position Ps1 and the first-run print end position Pe1 of the carriage, the printing scanning distance LP1 for which the carriage makes a constant speed movement is found. Then, the moving distances LA and LC of the carriage in the acceleration time A and the deceleration time (acceleration distance and deceleration distance) of the carriage, respectively, are added to the printing scanning distance LP1. Thereby, a distance L1 from the movement start position PS1 to the movement stop position PE1 is computed.

Next, comparing the first-run movement end position PE1 and the second-run movement start position PS2, a position of these positions further from the origin position PA is determined as a stop position of the carriage. In the example of FIG. 14, the position PS2 becomes the stop position of the carriage, and a distance from the position PS1 to the position PS2 is computed as the first-run moving distance Lx of the carriage.

Next, the flow moves to Step S206, where the first-run moving distance Lx computed based on the print data in Step S205 is compared with the first and second moving distances Dn1, Dn2 detected previously. The first and second moving distances Dn1, Dn2 are both moving distances in each of which the magnitudes of vibration of the printing apparatus become not larger than the predetermined value, respectively.

When the first-run moving distance Lx is not larger than the first moving distance Dn1, a first-run moving distance L of the carriage is set to the first moving distance Dn1 (Step S207A). When the first-run moving distance Lx is larger than the first moving distance Dn1 and not larger than the second moving distance Dn2, the first-run moving distance L of the carriage is set to the second moving distance Dn2 (Step S207B). When the first-run moving distance Lx is larger than the second moving distance Dn2, the first-run moving distance L of the carriage is set to the first-run moving distance Lx (Step S208). In the case of this example, as a stage (a) in FIG. 14, the first-run moving distance L is set to the first moving distance Dn1. As a result, the carriage moves to a position PE shifted from the position PS2.

In Step S209, printing scanning in the one direction is performed while the carriage M4001 is being moved in the one direction for the moving distance L being set up in this way. That is, the printing scanning of the one direction is performed by sending a signal to an un-illustrated ink discharge unit in the head cartridge H1000 mounted on the carriage M4001 based on the print data stored in the print buffer and making the ink discharge unit discharge the ink. In the subsequent Step S210, it is determined whether conveyance of the predetermined amount of paper form by the LF roller M3001 was completed.

When the conveyance of the predetermined amount of paper form is completed, the flow moves to Step S211, where it is confirmed whether there is the remainder of the print data to be printed. If there is print data to be printed, the flow goes back to Step S204, where the printing operation is repeated. If the printing is completed, the flow moves to Step S212, where the paper form is outputted in the output tray M1004 by driving the LF roller M3001 and a series of printing operations is ended.

In this operation, the flow goes back to Step S204 in order to perform the printing scanning of the second run. Then, based on the print data to be printed by a third-run movement of the carriage, a print start position Ps3 and a print end position Pe3 for the third run of the carriage, instead of the print start position Ps1 and the print end position Pe1 for the first run of the carriage, are computed.

In the subsequent Step S205, the second-run moving distance Lx of the carriage is computed as follows.

First, a printing scanning distance LP2 in which the carriage makes a constant speed movement is found with the print start position Ps2 and the print end position Pe2 of the second run of the carriage. Further, the moving distances LA and LC of the carriage in the acceleration time A and in the deceleration time C (acceleration distance and deceleration distance) are added to the printing scanning distance LP2. By this procedure, a distance L2 from the move start position PS2 to the move stop position PE2 is computed. Next, the move end position PE2 of the second run and the move start position PS3 of the third run are compared, and one position of them that is nearer the origin position PA is selected as a stop position of the carriage. In the example of FIG. 14, the position PS3 becomes a stop position of the second run of the carriage, and a distance between the position PS3 and the stop position PE of the first run of the carriage is denoted as the second-run moving distance Lx of the carriage.

Subsequently, as in the above-mentioned case, the second-run moving distance Lx is compared with the first and second moving distances Dn1, Dn2 (Step S206). According to the comparison result, the second-run moving distance L of the carriage is set up (Steps S207A, S207B, and S208). In the case of this example, as a stage (b) shown in FIG. 14, the second-run moving distance L is set to the second moving distance Dn2. As a result, the carriage moves to a position PE shifted from a position PS3.

The case where the printing scanning of the third- and subsequent-runs is performed will be the same.

In this way, the moving distance L of the carriage is set up by comparing the moving distance L computed based on the print data with the first and second moving distances Dn1, Dn2 in each of which the vibration of a table, rack, or the like on which the printing apparatus is installed becomes a magnitude not larger than the predetermined value. Thereby, the vibration resulting from reciprocating movements of the carriage M4001 can be controlled small.

Moreover, in the case of this example, at least two sets of drive conditions are each set as a set of drive conditions of the carriage M4001 under which the vibration of the printing apparatus becomes small, as described above. Then, based on either set of drive conditions of the two sets, the carriage M4001 is made to make a reciprocating movement. Therefore, the set of drive conditions of the carriage M4001 is not fixed to one set, but two kinds of moving distances of the carriage can be set up according to print data. Consequently, the print time can be shortened compared with the case where the set of drive conditions of the carriage is fixed to one.

Alternately, processing in Step S108 of FIG. 12 can also be performed in advance of processing in Step S107. In the case where the printing apparatus is configured in this way, if the magnitude of the vibration of the printing apparatus becomes not larger than the predetermined value during movement of the carriage M4001 by the set number, it is not necessarily required to make the carriage M4001 move by the set number. Therefore, processing of measuring the vibration of a table and a rack can be shortened. In the case of this example, although the number of reciprocating movements of the carriage M4001 in Step S107 of FIG. 12 was set to three times, the number is not particularly limited to this number. Moreover, in the case of this example, although the number of the set-up tables of drive conditions of the carriage M4001 as in FIG. 8 was set to 40, the number is not particularly limited to this number. Furthermore, although the round-trip time of the carriage was varied by 25 ms for tables in serial order, the round-trip time is not particularly limited to these values.

If the data quantity to be printed at the time of scanning in the one direction differs from the data quantity to be printed at the time of scanning in the other direction, the moving distance L of the carriage in the one direction may be set to a distance different from the moving distance L of the carriage in the other direction that follows it. However, even in this case, this invention has an effect to control the vibration to be small. That is, by setting the moving distances L at the time of scanning in the forward direction and the moving distances L at the time of scanning in the reverse direction to the moving distances Dn1 or Dn2, respectively, resonance of a table, rack, or the like on which the printing apparatus is installed can be avoided, as well as the case where the moving distances at the times of scanning in the forward and reverse directions are equal, as in the above-mentioned FIG. 10. Moreover, if the moving distance Lx exceeds the second moving distance Dn2, the moving distance L of the carriage M4001 is set to the moving distance Lx (Step S208), whereby the moving distance of the carriage required at least for printing can be secured.

Second Embodiment

In the above-mentioned first embodiment, regarding the drive conditions of the carriage M4001, the constant speed VT that the carriage M4001 should reach was set as a single value. In this embodiment, as in FIG. 15, a table in which a constant speed VT2 different from the case of drive conditions in FIG. 8 is further prepared. In this example, the constant speed VT2 that the carriage M4001 should reach is specified as 600 mm/s.

In FIG. 15, the acceleration time A2 and the deceleration time C2 are both set to 70 ms as in the previous case of FIG. 8. Constant-speed distances of respective table numbers are set to increase sequentially by a predetermined distance unit 12, which is 7.5 mm. There are 40 tables of such a specification.

In the case where a set of drive conditions is set up in this way, the period of one round trip of the carriage M4001 becomes between about 0.3 s to about 1.3 s as in the case of FIG. 8. Therefore, as was explained in the previous embodiment, the period of one round trip of the carriage, by which the vibration of a table and a rack on which the printing apparatus is installed is made to be small, becomes two times or four times the natural period of the table and the rack on which the printing apparatus is installed, that is, the former being even-number times the latter. Therefore, the tables of FIG. 15 become effective tables, as the tables in FIG. 8, for a table and a rack exhibiting a natural frequency of 3.2 Hz to 6.4 Hz.

Figure 16:
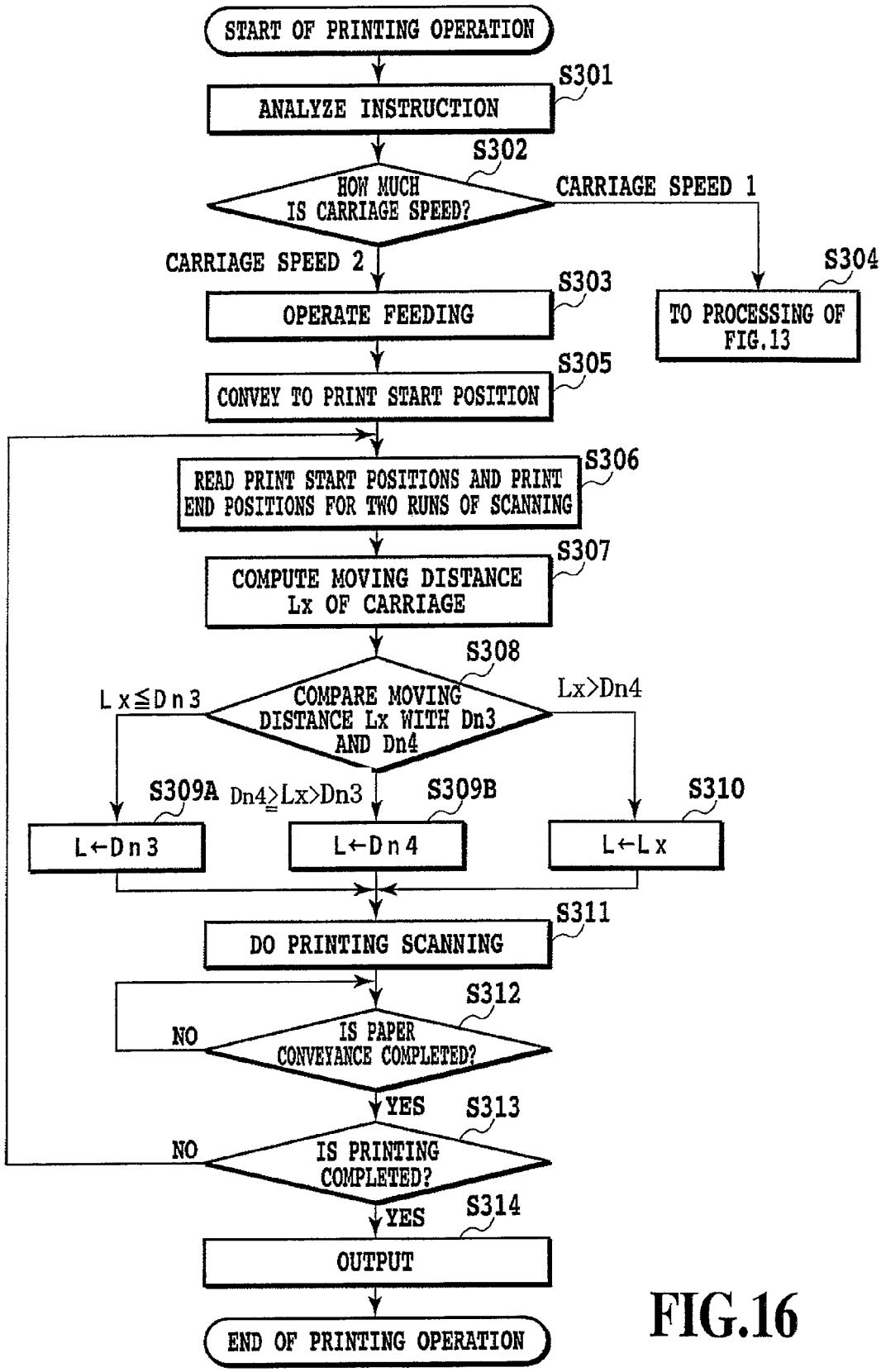
FIG. 16 is a flowchart for explaining a printing operation in the second embodiment of this invention.

FIG. 16 is a flowchart for explaining the printing operation that uses the set-up tables of drive conditions of FIG. 8 and FIG. 15 in this way. Incidentally, processing based on drive conditions in FIG. 15 that detects the first and second sets of drive conditions of the carriage under each of which the vibration of a table, rack, or the like becomes not larger than the predetermined value is the same as the processing of FIG. 12 in the previous embodiment, and so the explanation will be omitted here. Moving distances that are set up based on the first and second sets of drive conditions of the carriage detected similarly as the processing of FIG. 12 are denoted by first and second moving distances Dn3, Dn4.

First, the printing apparatus receives a print command from the host equipment, such as a personal computer, through an external I/F, and analyzes a content of the print command in Step S301. In the next Step S302, it is determined whether the commanded moving speed of the carriage M4001 is the speed 1 or the speed 2 based on its analysis result. The moving speed is the moving speed VT as in the previous embodiment, namely 400 mm/s and the moving speed 2 is the above-mentioned moving speed VT2, namely 600 mm/s. Printing when the moving speed 2 is commanded is done by, for example, thinning out predetermined dots, namely, in the so-called draft mode (or high-speed mode). In the case where the printing speed 1 (400 mm/s) is commanded in the determination in Step S302, the flow moves to Step S304, where processing of FIG. 13 described above is executed.

On the other hand, in the case where the printing speed 2 (600 mm/s) is commanded, the flow moves to Step S303, where the paper feeding operation is started. In Step S303, the paper feeding operation by the automatic feeding unit M2000 is started, and then in the next Step S305, the printing paper form is conveyed to the print start position. Subsequent processing in Step S306 to Step S314 is the same as that of Steps S204 to S212 of FIG. 13 described above, and so explanation of these processing steps will be omitted.

Thus, in this embodiment, the vibration of a table and a rack can be made small not only in the scanning speed VT in the previous first embodiment but also in the scanning speed VT2 different from VT. Therefore, it is not necessary to fix the scanning speed of the carriage M4001 used for controlling the vibration of a table, rack, or the like to be small. The vibration of a table, rack, or the like can be made to be small according to the scanning speed of the carriage M4001.

Third Embodiment

In the embodiments described above, in order to measure the vibration of a table, rack, or the like, the acceleration sensor E0022 shown in FIG. 4 was used. However, it is not necessarily required to use the acceleration sensor E0022 like this.

For example, the printing apparatus is constructed to comprise a printer driver that can instruct an operation of the printing apparatus etc. from the host equipment, such as a personal computer, further the printer driver being capable of instructing the carriage to make a reciprocating movement based on a set of drive conditions of the carriage as shown in FIG. 8 or FIG. 14. The user of the printing apparatus is expected to instruct the reciprocating movement of the carriage and directly check the vibration of a table, rack, or the like. Then, a set of drive conditions of the carriage under which it is determined that small vibration is generated is transmitted to the printing apparatus through the printer driver. The printing apparatus performs the processing as in FIG. 13 and FIG. 16 described above based on the set of the driving conditions transmitted, whereby the printing operation with small vibration can be performed.

(Others)

This invention is not limited to the ink-jet printing apparatus using the ink-jet printing head, but can be widely applicable to various printing apparatuses that use other printing heads, such as of a printing method of thermal printing.

Moreover, in the case where a printing operation (two-way printing) is performed while the printing head is made to make a reciprocating movement in the forward direction and in the reverse direction, a target speed (VT) at the time of these two-way moves can be set to the same value; therefore, it becomes easy to correlate a period of one reciprocating movement of the carriage and the natural period of a table, rack, or the like in order to control the vibration to be small as in FIG. 10 described above. In this case, a set of drive conditions for the movement in the one direction, from the start of the movement of the carriage in the one direction to the stop of it, may be different from a set of drive conditions for the movement in the other direction, from the start of the movement of the carriage in the other direction to the stop of it, depending on print data etc. What is necessary is that at least one of these sets of drive conditions can be set as a set of drive conditions by which the vibration can be controlled small.

Moreover, this invention is also effective in the case where the printing operation is performed at the time of moving the printing head only in the one direction (one-way printing). In the case of the one-way printing, normally the printing head moving in the other direction has a faster moving speed than that moving in the one direction, that is, that performing the printing operation. Also in this case, it is only essential that at least one of sets of drive conditions at the time of one direction movement and that at the time of the other direction movement can be set as a set of drive conditions that can control the vibration to be small.

Moreover, this invention dose not necessarily require the printing apparatus to be installed on a table, rack, or the like and can control the vibration resulting from the movement of the carriage to be small in various use conditions of the printing apparatus. The magnitude of vibration can be expressed by displacement, the speed, and the acceleration. Therefore, the magnitude of vibration can also be determined not only by the acceleration but also by the displacement or the speed or a combination of them.

Moreover, this invention does not necessarily require a plurality of sets of drive conditions that can control the vibration to be small. It is only essential that the moving distance of the carriage at the time of printing scanning can be altered so that the vibration is controlled small.

Moreover, especially this invention can control the vibration resulting from the movement of the carriage to be small effectively, in the case where the carriage is made to make reciprocating movements repeatedly based on the same set of drive conditions that can control the vibration to be small. Therefore, as a moving distance of the carriage at the time of each printing scanning, a moving distance of the carriage in which the vibration becomes small is set up commonly, whereby the vibration can be controlled small more effectively. In that case, it is natural that the moving distance of the carriage that is set up commonly is a distance equal to or more than the moving distance of the carriage at the time of each printing scanning required for printing an image. For example, when printing an image on printing paper form of a predetermined size, it is possible to set a moving distance exceeding the width of the printing paper form.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2004-358834 filed Dec. 10, 2004, which is hereby incorporated by reference herein.

What is claimed is:

1. A printing apparatus, comprising:

a carriage holding a printing head, configured to reciprocate along a predetermined direction with respect to a printing medium; and a controller configured to control movement of the carriage for printing with a specific drive condition selected from among a plurality of drive conditions, each of the drive conditions having a particular moving distance of reciprocation while the carriage reciprocates along the predetermined direction, vibration of an installation base on which the printing apparatus is installed caused by the reciprocation of the carriage being affected by the particular moving distance, wherein the controller is configured to perform control so as to successively reciprocate the carriage with each of the plurality of drive conditions, hold one or more of the drive conditions in which the vibration of the installation base is not greater than a predetermined magnitude, and set the specific drive condition in which the particular moving distance is equal to or greater than a required width for printing on the printing medium, the specific drive condition being selected from the held drive conditions.

2. The printing apparatus according to claim 1, further comprising a sensor configured to detect the vibration of the installation base, wherein the controller is configured to set the specific drive condition based on a detection result of the sensor.

3. The printing apparatus according to claim 1, further comprising a device configured to set the specific drive condition based on a user's instruction.

4. The printing apparatus according to claim 1, wherein the controller is configured to set the specific drive condition prior to actual printing.

5. The printing apparatus according to claim 1, wherein the controller is configured to perform control so as to successively reciprocate the carriage with each of the plurality of drive conditions in order of increasing particular moving distance of reciprocation, and set the specific drive condition of which the particular moving distance is closest to the required width, prior to actual printing.

6. The printing apparatus according to claim 5, wherein the controller comprises a data table storing different sets of the drive conditions, each of the drive conditions including a constant-speed distance, an acceleration time, a constant-speed time, a deceleration time, and the moving distance.

* * * * *